US008281856B2

(12) United States Patent
Jahn et al.

(10) Patent No.: US 8,281,856 B2
(45) Date of Patent: Oct. 9, 2012

(54) TORQUE SUB FOR USE WITH TOP DRIVE

(75) Inventors: Michael Jahn, Hambuehren (DE); Bernd-Georg Pietras, Wedemark (DE); Karsten Heidecke, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 13/274,424

(22) Filed: Oct. 17, 2011

(65) Prior Publication Data

US 2012/0031628 A1 Feb. 9, 2012

Related U.S. Application Data

(63) Continuation of application No. 12/813,981, filed on Jun. 11, 2010, now Pat. No. 8,047,283, which is a continuation of application No. 11/741,330, filed on Apr. 27, 2007, now Pat. No. 7,757,759.

(60) Provisional application No. 60/795,344, filed on Apr. 27, 2006.

(51) Int. Cl.
*E21B 19/16* (2006.01)

(52) U.S. Cl. ..... 166/250.01; 166/380; 166/77.51

(58) Field of Classification Search ..... 166/77.51, 166/378, 380

See application file for complete search history.

(56) References Cited

U.S. PATENT DOCUMENTS 2,924,967 A * 2/1960 Gieseler ..... 73/769
3,606,664 A 9/1971 Weiner
3,877,300 A * 4/1975 Ginns ..... 73/862.339
4,091,451 A 5/1978 Weiner et al.
4,199,032 A 4/1980 Weiner et al.
4,285,236 A 8/1981 Chien
4,365,402 A 12/1982 McCombs et al.
4,715,451 A 12/1987 Bseisu et al.
5,144,298 A 9/1992 Henneuse
5,202,681 A 4/1993 Dublin, Jr. et al.
5,272,925 A * 12/1993 Henneuse et al. ..... 73/862.541

(Continued)

FOREIGN PATENT DOCUMENTS

WO WO 00/05483 2/2000

(Continued)

OTHER PUBLICATIONS

Oyvind Rohn, Offjell Well Seerives Brochure (date Unknown).

(Continued)

*Primary Examiner* — William P Neuder
*Assistant Examiner* — Blake Michener
(74) *Attorney, Agent, or Firm* — Patterson & Sheridan, LLP

(57) ABSTRACT

A torque sub for use with a top drive is disclosed. A method of connecting threaded tubular members for use in a wellbore includes operating a top drive. The top drive rotates a first threaded tubular member relative to a second threaded tubular member. The method further includes measuring a torque exerted on the first tubular member by the top drive. The torque is measured using a torque shaft rotationally coupled to the top drive and the first tubular. The torque shaft has a strain gage disposed thereon. The method further includes wirelessly transmitting the measured torque from the torque shaft to a stationary interface; measuring rotation of the first tubular member; compensating the rotation measurement by subtracting a deflection of the top drive and/or the first tubular member; determining acceptability of the threaded connection; and stopping rotation of the first threaded member when the threaded connection is complete or if the threaded connection is unacceptable.

22 Claims, 17 Drawing Sheets

U.S. PATENT DOCUMENTS

| | | | | |
|---|---|---|---|---|
| 5,386,733 | A | 2/1995 | Hesthamar et al. | |
| 5,691,687 | A * | 11/1997 | Kumagai et al. | 336/120 |
| 6,018,136 | A | 1/2000 | Ohmi et al. | |
| 6,385,837 | B1 | 5/2002 | Murakami et al. | |
| 6,443,241 | B1 | 9/2002 | Juhasz et al. | |
| 6,527,493 | B1 | 3/2003 | Kamphorst et al. | |
| 6,742,596 | B2 | 6/2004 | Haugen | |
| 7,059,427 | B2 | 6/2006 | Power et al. | |
| 7,073,598 | B2 | 7/2006 | Haugen | |
| 7,096,977 | B2 | 8/2006 | Juhasz et al. | |
| 7,100,698 | B2 | 9/2006 | Kracik et al. | |
| 7,108,081 | B2 | 9/2006 | Boyadjieff | |
| 7,140,443 | B2 | 11/2006 | Beierbach et al. | |
| 7,281,587 | B2 | 10/2007 | Haugen | |
| 7,591,304 | B2 | 9/2009 | Juhasz et al. | |
| 7,654,158 | B2 | 2/2010 | Weems | |
| 7,665,533 | B2 | 2/2010 | Hopwood et al. | |
| 7,757,759 | B2 | 7/2010 | Jahn et al. | |
| 7,793,719 | B2 | 9/2010 | Snider et al. | |
| 8,047,283 | B2 | 11/2011 | Jahn et al. | |
| 2004/0144547 | A1 * | 7/2004 | Koithan et al. | 166/380 |
| 2007/0107912 | A1 | 5/2007 | Boutwell et al. | |
| 2007/0131416 | A1 | 6/2007 | Odell, II et al. | |
| 2008/0125876 | A1 | 5/2008 | Boutwell | |
| 2011/0016964 | A1 | 1/2011 | Strom | |

FOREIGN PATENT DOCUMENTS

| | | |
|---|---|---|
| WO | WO 2006/131813 | 12/2006 |

OTHER PUBLICATIONS

GB Search Report for Application No. GB1107000.0 dated Jun. 17, 2011.

G. H. Kamphorse, et al., Casing Running Tool, SPE/IADC 52770, Mar. 9-11, 1999, Amsterdam, Holland.

John Doyle, et al., Feedback Control Theory, Macmillan Publishing Co., 1990, pp. I, ii, 33-44 and 209-212.

* cited by examiner

TORQUE SUB FOR USE WITH TOP DRIVE

CROSS-REFERENCE TO RELATED APPLICATIONS

This application is a continuation of U.S. patent application Ser. No. 12/813,981 filed Jun. 11, 2010 now U.S. Pat. No. 8,047,283, which is a continuation of U.S. patent application Ser. No. 11/741,330, filed Apr. 27, 2007, now U.S. Pat. No. 7,757,759, which claims benefit of U.S. Provisional Patent Application No. 60/795,344, filed Apr. 27, 2006, all of which are herein incorporated by reference in their entireties.

BACKGROUND OF THE INVENTION

1. Field of the Invention

Embodiments of the present invention generally relate to a torque sub for use with a top drive.

2. Description of the Related Art

In wellbore construction and completion operations, a wellbore is initially formed to access hydrocarbon-bearing formations (i.e., crude oil and/or natural gas) by the use of drilling. Drilling is accomplished by utilizing a drill bit that is mounted on the end of a drill support member, commonly known as a drill string. To drill within the wellbore to a predetermined depth, the drill string is often rotated by a top drive or rotary table on a surface platform or rig, or by a downhole motor mounted towards the lower end of the drill string. After drilling to a predetermined depth, the drill string and drill bit are removed and a section of casing is lowered into the wellbore. An annular area is thus formed between the string of casing and the formation. The casing string is temporarily hung from the surface of the well. A cementing operation is then conducted in order to fill the annular area with cement. Using apparatus known in the art, the casing string is cemented into the wellbore by circulating cement into the annular area defined between the outer wall of the casing and the borehole. The combination of cement and casing strengthens the wellbore and facilitates the isolation of certain areas of the formation behind the casing for the production of hydrocarbons.

A drilling rig is constructed on the earth's surface to facilitate the insertion and removal of tubular strings (i.e., drill strings or casing strings) into a wellbore. The drilling rig includes a platform and power tools such as an elevator and a spider to engage, assemble, and lower the tubulars into the wellbore. The elevator is suspended above the platform by a draw works that can raise or lower the elevator in relation to the floor of the rig. The spider is mounted in the platform floor. The elevator and spider both have slips that are capable of engaging and releasing a tubular, and are designed to work in tandem. Generally, the spider holds a tubular or tubular string that extends into the wellbore from the platform. The elevator engages a new tubular and aligns it over the tubular being held by the spider. One or more power drives, i.e. a power tong and a spinner, are then used to thread the upper and lower tubulars together. Once the tubulars are joined, the spider disengages the tubular string and the elevator lowers the tubular string through the spider until the elevator and spider are at a predetermined distance from each other. The spider then re-engages the tubular string and the elevator disengages the string and repeats the process. This sequence applies to assembling tubulars for the purpose of drilling, running casing or running wellbore components into the well. The sequence can be reversed to disassemble the tubular string.

Historically, a drilling platform includes a rotary table and a gear to turn the table. In operation, the drill string is lowered by an elevator into the rotary table and held in place by a spider. A Kelly is then threaded to the string and the rotary table is rotated, causing the Kelly and the drill string to rotate. After thirty feet or so of drilling, the Kelly and a section of the string are lifted out of the wellbore and additional drill string is added.

The process of drilling with a Kelly is time-consuming due to the amount of time required to remove the Kelly, add drill string, reengage the Kelly, and rotate the drill string. Because operating time for a rig is very expensive, as much as $500,000 per day, the time spent drilling with a Kelly quickly equates to substantial cost. In order to address these problems, top drives were developed. Top drive systems are equipped with a motor to provide torque for rotating the drilling string. The quill of the top drive is connected (typically by a threaded connection) to an upper end of the drill pipe in order to transmit torque to the drill pipe.

Another method of performing well construction and completion operations involves drilling with casing, as opposed to the first method of drilling and then setting the casing. In this method, the casing string is run into the wellbore along with a drill bit. The drill bit is operated by rotation of the casing string from the surface of the wellbore. Once the borehole is formed, the attached casing string may be cemented in the borehole. This method is advantageous in that the wellbore is drilled and lined in the same trip.

FIG. 1A is a side view of an upper portion of a drilling rig 10 having a top drive 100 and an elevator 35. An upper end of a stack of tubulars 70 is shown on the rig 10. The FIG. shows the elevator 35 engaged with one of the tubulars 70. The tubular 70 is placed in position below the top drive 100 by the elevator 35 in order for the top drive having a gripping device (i.e., spear 200 or torque head 300) to engage the tubular.

FIG. 1B is a side view of a drilling rig 10 having a top drive 100, an elevator 35, and a spider 60. The rig 10 is built at the surface 45 of the wellbore 50. The rig 10 includes a traveling block 20 that is suspended by wires 25 from draw works 15 and holds the top drive 100. The top drive 100 has the spear 200 (alternatively, a torque head 300) for engaging the inner wall (outer wall for torque head 400) of tubular 70 and a motor 140 to rotate the tubular 70. The motor 140 may be either electrically or hydraulically driven. The motor 140 rotates and threads the tubular 70 into the tubular string 80 extending into the wellbore 50. The motor 140 can also rotate a drill string having a drill bit at an end, or for any other purposes requiring rotational movement of a tubular or a tubular string. Additionally, the top drive 100 is shown having a railing system 30 coupled thereto. The railing system 30 prevents the top drive 100 from rotational movement during rotation of the tubular 70, but allows for vertical movement of the top drive under the traveling block 110.

In FIG. 1B, the top drive 100 is shown engaged to tubular 70. The tubular 70 is positioned above the tubular string 80 located therebelow. With the tubular 70 positioned over the tubular string 80, the top drive 100 can lower and thread the tubular into the tubular string. Additionally, the spider 60, disposed in a platform 40 of the drilling rig 100, is shown engaged around the tubular string 80 that extends into wellbore 50.

FIG. 1C illustrates a side view of the top drive 100 engaged to the tubular 70, which has been connected to the tubular string 80 and lowered through the spider 60. As depicted in the FIG., the elevator 35 and the top drive 100 are connected to the traveling block 20 via a compensator 170. The compensator 170 functions similar to a spring to compensate for vertical movement of the top drive 100 during threading of the tubular 70 to the tubular string 80. In addition to its motor 140, the top drive includes a counter 150 to measure rotation of the tubular 70 as it is being threaded to tubular string 80. The top drive 100 also includes a torque sub 160 to measure the amount of torque placed on the threaded connection between the tubular 70 and the tubular string 80. The counter 150 and the torque sub 160 transmit data about the threaded joint to a controller via data lines (not shown). The controller is pre-programmed with acceptable values for rotation and torque for a particular joint. The controller compares the rotation and the torque data to the stored acceptable values.

FIG. 1C also illustrates the spider 60 disposed in the platform 40. The spider 60 comprises a slip assembly 66, including a set of slips 62, and piston 64. The slips 62 are wedge-shaped and are constructed and arranged to slide along a sloped inner wall of the slip assembly 66. The slips 62 are raised or lowered by piston 64. When the slips 62 are in the lowered position, they close around the outer surface of the tubular string 80. The weight of the tubular string 80 and the resulting friction between the tubular string 80 and the slips 62, force the slips downward and inward, thereby tightening the grip on the tubular string. When the slips 62 are in the raised position as shown, the slips are opened and the tubular string 80 is free to move longitudinally in relation to the slips.

FIG. 2A is a cross-sectional view of the spear 200, for coupling the top drive 100 and the tubular 70, in disengaged and engaged positions, respectively. The spear 200 includes a cylindrical body 205, a wedge lock assembly 250, and slips 240 with teeth (not shown). The wedge lock assembly 250 and the slips 240 are disposed around the outer surface of the cylindrical body 200. The slips 240 are constructed and arranged to mechanically grip the inside of the tubular 70. The slips 240 are threaded to piston 270 located in a hydraulic cylinder 210. The piston 270 is actuated by pressurized hydraulic fluid injected through fluid ports 220, 230. Additionally, springs 260 are located in the hydraulic cylinder 210 and are shown in a compressed state. When the piston 270 is actuated, the springs decompress and assist the piston in moving the slips 240. The wedge lock assembly 250 is constructed and arranged to force the slips 240 against the inner wall of the tubular 70 and moves with the cylindrical body 205.

In operation, the slips 240, and the wedge lock assembly 250 of top drive 100 are lowered inside tubular 70. Once the slips 240 are in the desired position within the tubular 70, pressurized fluid is injected into the piston 270 through fluid port 220. The fluid actuates the piston 270, which forces the slips 240 towards the wedge lock assembly 250. The wedge lock assembly 250 functions to bias the slips 240 outwardly as the slips are slid along the outer surface of the assembly, thereby forcing the slips to engage the inner wall of the tubular 70.

FIG. 2B is a cross-sectional view of the spear 200, in the engaged position. The FIG. shows slips 240 engaged with the inner wall of the tubular 70 and a spring 260 in the decompressed state. In the event of a hydraulic fluid failure, the spring 260 can bias the piston 270 to keep the slips 240 in the engaged position, thereby providing an additional safety feature to prevent inadvertent release of the tubular string 80. Once the slips 240 are engaged with the tubular 70, the top drive 100 can be raised along with the cylindrical body 205. By raising the body 205, the wedge lock assembly 250 will further bias the slips 240. With the tubular 70 engaged by the top drive 100, the top drive can be relocated to align and thread the tubular with tubular string 80.

Alternatively, the top drive 100 may be equipped with the torque head 300 instead of the spear 200. The spear 200 may be simply unscrewed from the quill (tip of top drive 100 shown in FIGS. 2A and 2B) and the torque head 300 is screwed on the quill in its place. The torque head 300 grips the tubular 70 on the outer surface instead of the inner surface. FIG. 3 is a cross-sectional view of a prior art torque head 300. The torque head 300 is shown engaged with the tubular 70. The torque head 300 includes a housing 305 having a central axis. A top drive connector 310 is disposed at an upper portion of the housing 305 for connection with the top drive 100. Preferably, the top drive connector 310 defines a bore therethrough for fluid communication. The housing 305 may include one or more windows 306 for accessing the housing's interior.

The torque head 300 may optionally employ a circulating tool 320 to supply fluid to fill up the tubular 70 and circulate the fluid. The circulating tool 320 may be connected to a lower portion of the top drive connector 310 and disposed in the housing 305. The circulating tool 320 includes a mandrel 322 having a first end and a second end. The first end is coupled to the top drive connector 310 and fluidly communicates with the top drive 100 through the top drive connector 310. The second end is inserted into the tubular 70. A cup seal 325 and a centralizer 327 are disposed on the second end interior to the tubular 70. The cup seal 325 sealingly engages the inner surface of the tubular 70 during operation. Particularly, fluid in the tubular 70 expands the cup seal 325 into contact with the tubular 70. The centralizer 327 co-axially maintains the tubular 70 with the central axis of the housing 205. The circulating tool 320 may also include a nozzle 328 to inject fluid into the tubular 70. The nozzle 328 may also act as a mud saver adapter 328 for connecting a mud saver valve (not shown) to the circulating tool 320.

Optionally, a tubular stop member 330 may be disposed on the mandrel 322 below the top drive connector 310. The stop member 330 prevents the tubular 70 from contacting the top drive connector 310, thereby protecting the tubular 70 from damage. To this end, the stop member 330 may be made of an elastomeric material to substantially absorb the impact from the tubular 70.

One or more retaining members 340 are employed to engage the tubular 70. As shown, the torque head 300 includes three retaining members 340 mounted in spaced apart relation about the housing 305. Each retaining member 340 includes a jaw 345 disposed in a jaw carrier 342. The jaw 345 is adapted and designed to move radially relative to the jaw carrier 342. Particularly, a back portion of the jaw 345 is supported by the jaw carrier 342 as it moves radially in and out of the jaw carrier 342. In this respect, a longitudinal load acting on the jaw 345 may be transferred to the housing 305 via the jaw carrier 342. Preferably, the contact portion of the jaw 345 defines an arcuate portion sharing a central axis with the tubular 70. The jaw carrier 342 may be formed as part of the housing 305 or attached to the housing 305 as part of the gripping member assembly.

Movement of the jaw 345 is accomplished by a piston 351 and cylinder 350 assembly. In one embodiment, the cylinder 350 is attached to the jaw carrier 342, and the piston 351 is movably attached to the jaw 345. Pressure supplied to the backside of the piston 351 causes the piston 351 to move the jaw 345 radially toward the central axis to engage the tubular 70. Conversely, fluid supplied to the front side of the piston 351 moves the jaw 345 away from the central axis. When the appropriate pressure is applied, the jaws 345 engage the tubular 70, thereby allowing the top drive 100 to move the tubular 70 longitudinally or rotationally.

The piston 351 may be pivotably connected to the jaw 345. As shown, a pin connection 355 is used to connect the piston 351 to the jaw 345. A pivotable connection limits the transfer of a longitudinal load on the jaw 345 to the piston 351. Instead, the longitudinal load is mostly transmitted to the jaw carrier 342 or the housing 305. In this respect, the pivotable connection reduces the likelihood that the piston 351 may be bent or damaged by the longitudinal load.

The jaws 345 may include one or more inserts 360 movably disposed thereon for engaging the tubular 70. The inserts 360, or dies, include teeth formed on its surface to grippingly engage the tubular 70 and transmit torque thereto. The inserts 360 may be disposed in a recess 365 as shown in FIG. 3A. One or more biasing members 370 may be disposed below the inserts 360. The biasing members 370 allow some relative movement between the tubular 70 and the jaw 345. When the tubular 70 is released, the biasing member 370 moves the inserts 360 back to the original position. Optionally, the inserts 360 and the jaw recess 365 are correspondingly tapered (not shown).

The outer perimeter of the jaw 345 around the jaw recess 365 may aide the jaws 345 in supporting the load of the tubular 70 and/or tubular string 80. In this respect, the upper portion of the perimeter provides a shoulder 380 for engagement with the coupling 72 on the tubular 70 as illustrated FIGS. 3 and 3A. The longitudinal load, which may come from the tubular 70 string 70,80, acting on the shoulder 380 may be transmitted from the jaw 345 to the housing 305.

A base plate 385 may be attached to a lower portion of the torque head 300. A guide plate 390 may be selectively attached to the base plate 385 using a removable pin connection. The guide plate 390 has an inclined edge 393 adapted and designed to guide the tubular 70 into the housing 305. The guide plate 390 may be quickly adjusted to accommodate tubulars of various sizes. One or more pin holes 392 may be formed on the guide plate 390, with each pin hole 392 representing a certain tubular size. To adjust the guide plate 390, the pin 391 is removed and inserted into the designated pin hole 392. In this manner, the guide plate 390 may be quickly adapted for use with different tubulars.

A typical operation of a string or casing assembly using a top drive and a spider is as follows. A tubular string 80 is retained in a closed spider 60 and is thereby prevented from moving in a downward direction. The top drive 100 is then moved to engage the tubular 70 from a stack with the aid of an elevator 35. The tubular 70 may be a single tubular or could typically be made up of three tubulars threaded together to form a joint. Engagement of the tubular 70 by the top drive 100 includes grasping the tubular and engaging the inner (or outer) surface thereof. The top drive 100 then moves the tubular 70 into position above the tubular string 80. The top drive 100 then threads the tubular 70 to tubular string 80.

The spider 60 is then opened and disengages the tubular string 80. The top drive 100 then lowers the tubular string 80, including tubular 70, through the opened spider 60. The spider 60 is then closed around the tubular string 80. The top drive 100 then disengages the tubular string 80 and can proceed to add another tubular 70 to the tubular string 80. The above-described acts may be utilized in running drill string in a drilling operation, in running casing to reinforce the wellbore, or for assembling strings to place wellbore components in the wellbore. The steps may also be reversed in order to disassemble the tubular string.

When joining lengths of tubulars (i.e., production tubing, casing, drill pipe, any oil country tubular good, etc.; collectively referred to herein as tubulars) for oil wells, the nature of the connection between the lengths of tubing is critical. It is conventional to form such lengths of tubing to standards prescribed by the American Petroleum Institute (API). Each length of tubing has an internal threading at one end and an external threading at another end. The externally-threaded end of one length of tubing is adapted to engage in the internally-threaded end of another length of tubing. API type connections between lengths of such tubing rely on thread interference and the interposition of a thread compound to provide a seal.

For some oil well tubing, such API type connections are not sufficiently secure or leakproof. In particular, as the petroleum industry has drilled deeper into the earth during exploration and production, increasing pressures have been encountered. In such environments, where API type connections are not suitable, it is conventional to utilize so-called "premium grade" tubing which is manufactured to at least API standards but in which a metal-to-metal sealing area is provided between the lengths. In this case, the lengths of tubing each have tapered surfaces which engage one another to form the metal-to-metal sealing area. Engagement of the tapered surfaces is referred to as the "shoulder" position/condition.

Whether the threaded tubulars are of the API type or are premium grade connections, methods are needed to ensure a good connection. One method involves the connection of two co-operating threaded pipe sections, rotating a first pipe section relative to a second pipe section by a power tongs, measuring the torque applied to rotate the first section relative to the second section, and the number of rotations or turns which the first section makes relative to the second section. Signals indicative of the torque and turns are fed to a controller which ascertains whether the measured torque and turns fall within a predetermined range of torque and turns which are known to produce a good connection. Upon reaching a torque-turn value within a prescribed minimum and maximum (referred to as a dump value), the torque applied by the power tongs is terminated. An output signal, e.g. an audible signal, is then operated to indicate whether the connection is a good or a bad connection.

FIG. 4A illustrates one form of a premium grade tubing connection. In particular, FIG. 4A shows a tapered premium grade tubing assembly 400 having a first tubular 402 joined to a second tubular 404 through a tubing coupling or box 406. The end of each tubular 402,404 has a tapered externally-threaded surface 408 which co-operates with a correspondingly tapered internally-threaded surface 410 on the coupling 406. Each tubular 402,404 is provided with a tapered torque shoulder 412 which co-operates with a correspondingly tapered torque shoulder 414 on the coupling 406. At a terminal end of each tubular 402,404, there is defined an annular sealing area 416 which is engageable with a co-operating annular sealing area 418 defined between the tapered portions 410,414 of the coupling 406.

During make-up, the tubulars 402, 404 (also known as pins), are engaged with the box 406 and then threaded into the box by relative rotation therewith. During continued rotation, the annular sealing areas 416, 418 contact one another, as shown in FIG. 4B. This initial contact is referred to as the "seal condition". As the tubing lengths 402,404 are further rotated, the co-operating tapered torque shoulders 412,414 contact and bear against one another at a machine detectable stage referred to as a "shoulder condition" or "shoulder torque", as shown in FIG. 4C. The increasing pressure interface between the tapered torque shoulders 412,414 cause the seals 416,418 to be forced into a tighter metal-to-metal sealing engagement with each other causing deformation of the seals 416 and eventually forming a fluid-tight seal.

During make-up of the tubulars 402,404, torque may be plotted with respect to turns. FIG. 5A shows a typical x-y plot (curve 500) illustrating the acceptable behavior of premium grade tubulars, such as the tapered premium grade tubing assembly 400 shown in FIGS. 4A-C. FIG. 5B shows a corresponding chart plotting the rate of change in torque (y-axis) with respect to turns (x-axis). Shortly after the tubing lengths engage one another and torque is applied (corresponding to FIG. 4A), the measured torque increases substantially linearly as illustrated by curve portion 502. As a result, corresponding curve portion 502*a* of the differential curve 500*a* of FIG. 5B is flat at some positive value.

During continued rotation, the annular sealing areas 416, 418 contact one another causing a slight change (specifically, an increase) in the torque rate, as illustrated by point 504. Thus, point 504 corresponds to the seal condition shown in FIG. 4B and is plotted as the first step 504*a* of the differential curve 500*a*. The torque rate then again stabilizes resulting in the linear curve portion 506 and the plateau 506*a*. In practice, the seal condition (point 504) may be too slight to be detectable. However, in a properly behaved make-up, a discernable/detectable change in the torque rate occurs when the shoulder condition is achieved (corresponding to FIG. 4C), as represented by point 508 and step 508*a*.

The following formula is used to calculate the rate of change in torque with respect to turns:

Rate of Change (ROC) Calculation

Let $T_1, T_2, T_3, \ldots T_x$ represent an incoming stream of torque values.

Let $C_1, C_2, C_3, \ldots C_X$ represent an incoming stream of turns values that are paired with the Torque values.

Let y represent the turns increment number>1.

The Torque Rate of Change to Turns estimate (ROC) is defined by:

$ROC := (T_y - T_{y-1})/(C_y - C_{y-1})$ in Torque units per Turns units.

Once the shoulder condition is detected, some predetermined torque value may be added to achieve the terminal connection position (i.e., the final state of a tubular assembly after make-up rotation is terminated). The predetermined torque value is added to the measured torque at the time the shoulder condition is detected.

As indicated above, for premium grade tubulars, a leak-proof metal-to-metal seal is to be achieved, and in order for the seal to be effective, the amount of torque applied to affect the shoulder condition and the metal-to-metal seal is critical. In the case of premium grade connections, the manufacturers of the premium grade tubing publish torque values required for correct makeup utilizing a particular tubing. Such published values may be based on minimum, optimum and maximum torque values, minimum and maximum torque values, or an optimum torque value only. Current practice is to makeup the connection to within a predetermined torque range while plotting the applied torque vs. rotation or time, and then make a visual inspection and determination of the quality of the makeup.

It would be advantageous to employ top drives in the make-up of premium tubulars. However, available torque subs (i.e., torque sub 160) for top drives do not possess the required accuracy for the intricate process of making up premium tubulars. Current top drive torque subs operate by measuring the voltage and current of the electricity supplied to an electric motor or the pressure and flow rate of fluid supplied to a hydraulic motor. Torque is then calculated from these measurements. This principle of operation neglects friction inside a transmission gear of the top drive and inertia of the top drive, which are substantial. Therefore, there exists a need in the art for a more accurate top drive torque sub.

SUMMARY OF THE INVENTION

Embodiments of the present invention generally relate to a torque sub for use with a top drive. In one embodiment a method of connecting threaded tubular members for use in a wellbore is disclosed. The method includes operating a top drive, thereby rotating a first threaded tubular member relative to a second threaded tubular member; measuring a torque exerted on the first tubular member by the top drive, wherein the torque is measured using a torque shaft rotationally coupled to the top drive and the first tubular, the torque shaft having a strain gage disposed thereon; wirelessly transmitting the measured torque from the torque shaft to a stationary interface; measuring rotation of the first tubular member; determining acceptability of the threaded connection; and stopping rotation of the first threaded member when the threaded connection is complete or if the threaded connection is unacceptable.

In another embodiment, a system for connecting threaded tubular members for use in a wellbore is disclosed. The system includes a top drive operable to rotate a first threaded tubular member relative to a second threaded tubular member; and a torque sub. The torque sub includes a torque shaft rotationally coupled to the top drive; a strain gage disposed on the torque shaft for measuring a torque exerted on the torque shaft by the top drive; and an antenna in communication with the strain gage. The system further includes a turns counter for measuring rotation of the first tubular; an antenna in electromagnetic communication with the torque sub antenna and located at a stationary position relative to the top drive; and a computer. The computer is located at a stationary position relative to the top drive; in communication with the stationary antenna and the turns counter; and configured to perform an operation. The operation includes monitoring the torque and rotation measurements during rotation of the first tubular member relative to the second tubular member; determining acceptability of the threaded connection; and stopping rotation of the first threaded member when the threaded connection is complete or if the computer determines that the threaded connection is unacceptable.

In another embodiment, a system for connecting threaded tubular members for use in a wellbore is disclosed. The system includes a top drive operable to rotate a first threaded tubular member relative to a second threaded tubular member; and a torque sub. The torque sub includes a torque shaft rotationally coupled to the top drive; and a strain gage disposed on the torque shaft for measuring a torque exerted on the torque shaft by the top drive; first and second connectors, each connector rotationally coupled to a respective end of the torque shaft; and first and second links longitudinally coupling the connectors together so that only torque is exerted on the torque shaft. The system further includes a turns counter for measuring rotation of the first tubular.

In another embodiment, a method of connecting threaded tubular members for use in a wellbore is disclosed. The method includes operating a top drive, thereby rotating a first threaded tubular member relative to a second threaded tubular member; measuring a torque exerted on the first tubular member by the top drive, wherein the torque is measured using upper and lower turns counters, each turns counter disposed proximate to a respective longitudinal end of the first tubular; and measuring rotation of the first tubular member, wherein the rotation is measured using the lower turns counter.

In another embodiment, a system for connecting threaded tubular members for use in a wellbore is disclosed. The system includes a top drive operable to rotate a first threaded tubular member relative to a second threaded tubular member; an upper turns counter for measuring rotation of an upper longitudinal end of the first tubular; and a lower turns counter for measuring rotation of a lower longitudinal end of the first tubular.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 6:
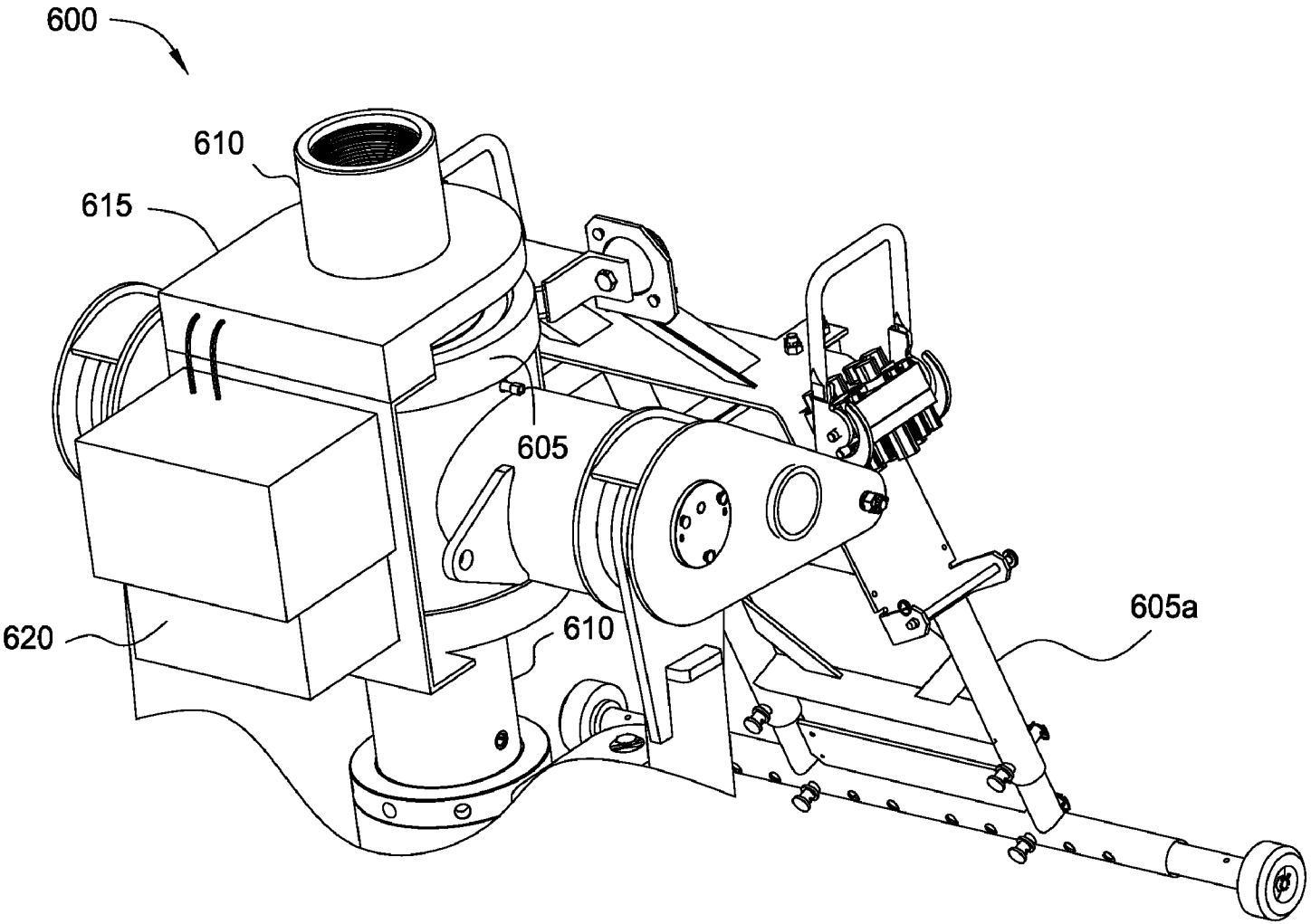
FIG. 6 is an isometric view of a torque sub, according to one embodiment of the present invention.

FIG. 6 is an isometric view of a torque sub 600, according to one embodiment of the present invention. The torque sub 600 includes a housing 605, a torque shaft 610, an interface 615, and a controller 620. The housing 605 is a tubular member having a bore therethrough. The housing 605 includes a bracket 605*a* for coupling the housing 605 to the railing system 30, thereby preventing rotation of the housing 605 during rotation of the tubular, but allowing for vertical movement of the housing with the top drive 100 under the traveling block 110. The interface 615 and the controller 620 are both mounted on the housing 605. The housing 605 and the torque shaft 610 are made from metal, preferably stainless steel. The interface 615 is made from a polymer. Preferably, the elevator 35 (only partially shown) is also mounted on the housing 605, although this is not essential to the present invention.

Figure 6D:
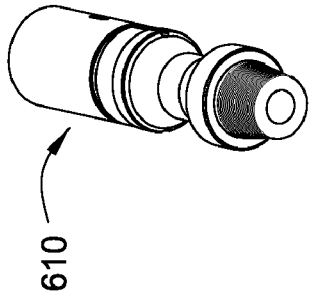
FIG. 6D is an isometric view of the torque shaft.
Figure 6C:
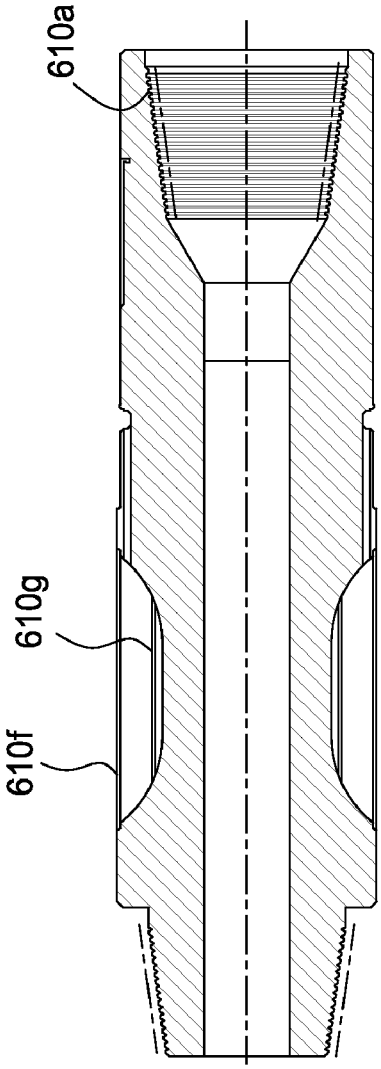
FIG. 6C is a cross section of FIG. 6A.
Figure 6A:
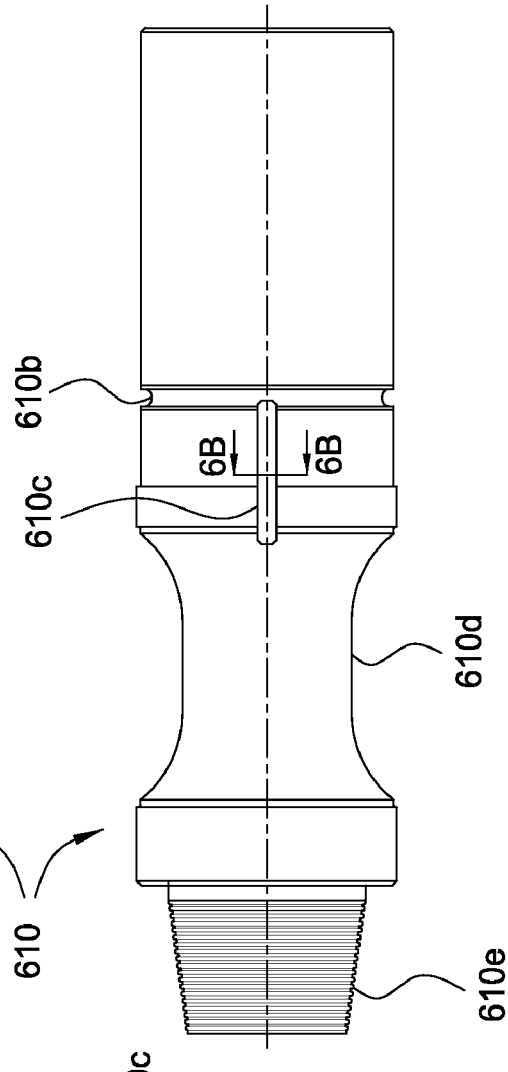
FIG. 6A is a side view of a torque shaft of the torque sub.
Figure 6B:
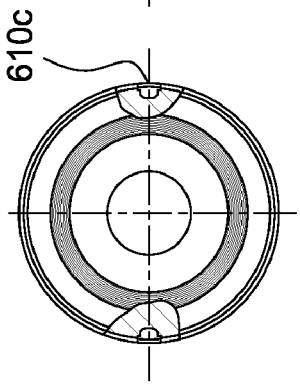
FIG. 6B is an end view of the torque shaft with a partial sectional view cut along line 6B-6B of FIG. 6A.

FIG. 6A is a side view of the torque shaft 610 of the torque sub 600. FIG. 6B is an end view of the torque shaft 610 with a partial sectional view cut along line 6B-6B of FIG. 6A. FIG. 6C is a cross section of FIG. 6A. FIG. 6D is an isometric view of the torque shaft 610. The torque shaft 610 is a tubular member having a flow bore therethrough. The torque shaft 610 is disposed through the bore of the housing 605 so that it may rotate relative to the housing 605. The torque shaft 610 includes a threaded box 610*a*, a groove 610*b*, one or more longitudinal slots 610*c* (preferably two), a reduced diameter portion 610*d*, and a threaded pin 610*e*, a metal sleeve 610*f*, and a polymer (preferably rubber, more preferably silicon rubber) shield 610*g*.

The threaded box 610*a* receives the quill of the top drive 100, thereby forming a rotational connection therewith. The pin 610*e* is received by either a box of the spear body 205 or the top drive connector 310 of the torque head 300, thereby forming a rotational connection therewith. The groove 610*b* receives a secondary coil 630*b* (see FIG. 6I) which is wrapped therearound. Disposed on an outer surface of the reduced diameter portion 610*d* are one or more strain gages 680 (see FIGS. 6E-6H). The strain gages 680 are disposed on the reduced diameter portion 610*d* at a sufficient distance from either taper so that stress/strain transition effects at the tapers are fully dissipated. The slots 610*c* provide a path for wiring between the secondary coil 630*b* and the strain gages 680 and also house an antenna 645*a* (see FIG. 6I).

The shield 610*g* is disposed proximate to the outer surface of the reduced diameter portion 610*d*. The shield 610*g* may be applied as a coating or thick film over strain gages 680. Disposed between the shield 610*g* and the sleeve 610*f* are electronic components (see FIG. 6I). The electronic components are encased in a polymer mold 630 (see FIG. 6I). The shield 610*g* absorbs any forces that the mold 630 may otherwise exert on the strain gages 680 due to the hardening of the mold. The shield 610*g* also protects the delicate strain gages 680 from any chemicals present at the wellsite that may otherwise be inadvertently splattered on the strain gages 680. The sleeve 610*f* is disposed along the reduced diameter portion 610*d*. A recess is formed in each of the tapers to seat the shield 610*f*. The sleeve 610*f* forms a substantially continuous outside diameter of the torque shaft 610 through the reduced diameter portion 610*d*. Preferably, the sleeve 610*f* is made from sheet metal and welded to the shaft 610. The sleeve 610*f* also has an injection port formed therethrough (not shown) for filling fluid mold material to encase the electronic components.

Figure 6G:
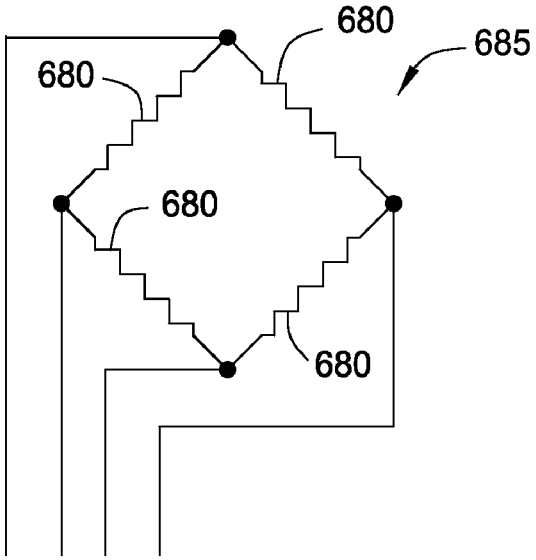
FIG. 6G is a schematic of four strain gages in a Wheatstone bridge configuration.
Figure 6H:
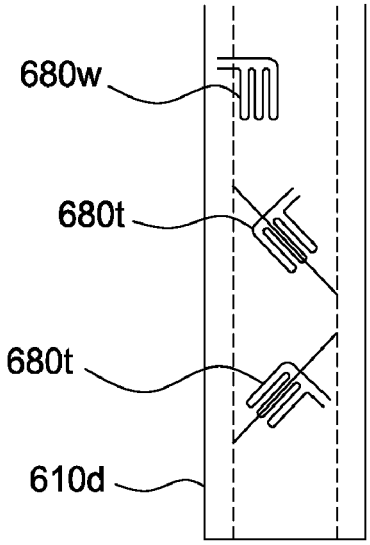
FIG. 6H is a schematic of strain gages mounted on the tapered portion of the torque shaft.
Figure 6E:
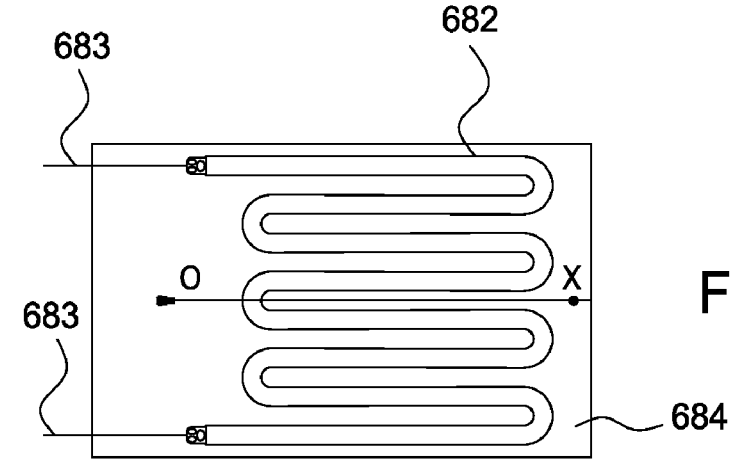
FIG. 6E is a top view of a strain gage.
Figure 6F:
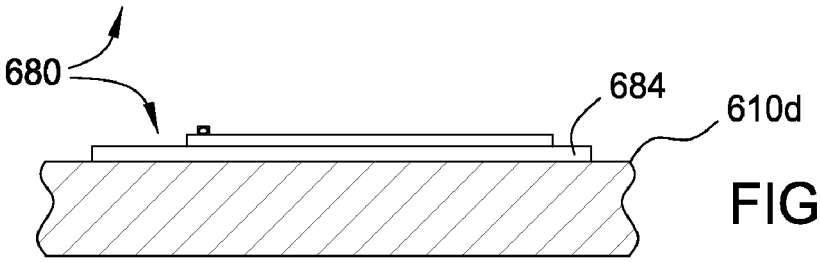
FIG. 6F is a partial section of a reduced diameter portion of the torque shaft showing the strain gage of FIG. 6E mounted thereon.

FIG. 6E is a top view of the strain gage 680. FIG. 6F is a partial section of the reduced diameter portion 610*d* of the torque shaft 610 showing the strain gage of FIG. 6E mounted thereon. FIG. 6G is a schematic of four strain gages 680 in a Wheatstone bridge 685 configuration. FIG. 6H is a schematic of strain gages 680*t,w* mounted on the tapered portion 610*d* of the torque shaft 610.

Preferably, each strain gage 680 is made of a thin foil grid 682 and bonded to the tapered portion 610*d* of the shaft 610 by a polymer support 684, such as an epoxy glue. The foil 682 strain gauges 680 are made from metal, such as platinum, tungsten/nickel, or chromium. The sensitive part of each strain gage 680 is along the straight part (parallel to longitudinal axis o-x) of the conducting foil 682. When elongated, this conducting foil 682 increases in resistance. The resistance may be measured by connecting the strain gage 680 to an electrical circuit via terminal wires 683. Two gages 680 are usually configured in a Wheatstone bridge 685 to increase sensitivity. Two more gages 680 not submitted to the strain are added to compensate for temperature variation. The longitudinal load acting on the torque shaft 610 is measured by orientating a strain gage 680*w* with its longitudinal axis o-x parallel to the longitudinal axis of the torque shaft 610. The torque acting on the torque shaft 610 is measured by orienting a strain gage 680*t* with its longitudinal axis o-x at a forty-five degree angle relative to the longitudinal axis of the torque shaft 610 and another strain gage 680*t* at a negative forty-five degree angle relative to the longitudinal axis of the torque shaft 610. Preferably, each of the strain gages 680*t*,680*t*,680*w* is a Wheatstone bridge 685 made up of four strain gages 680. Alternatively, semi-conductor strain gauges (not shown) or piezoelectric (crystal) strain gages may be used in place of the foil strain gauges 680. Alternatively, only a single strain gage 680*t* may be disposed on the shaft 610.

Figure 6I:
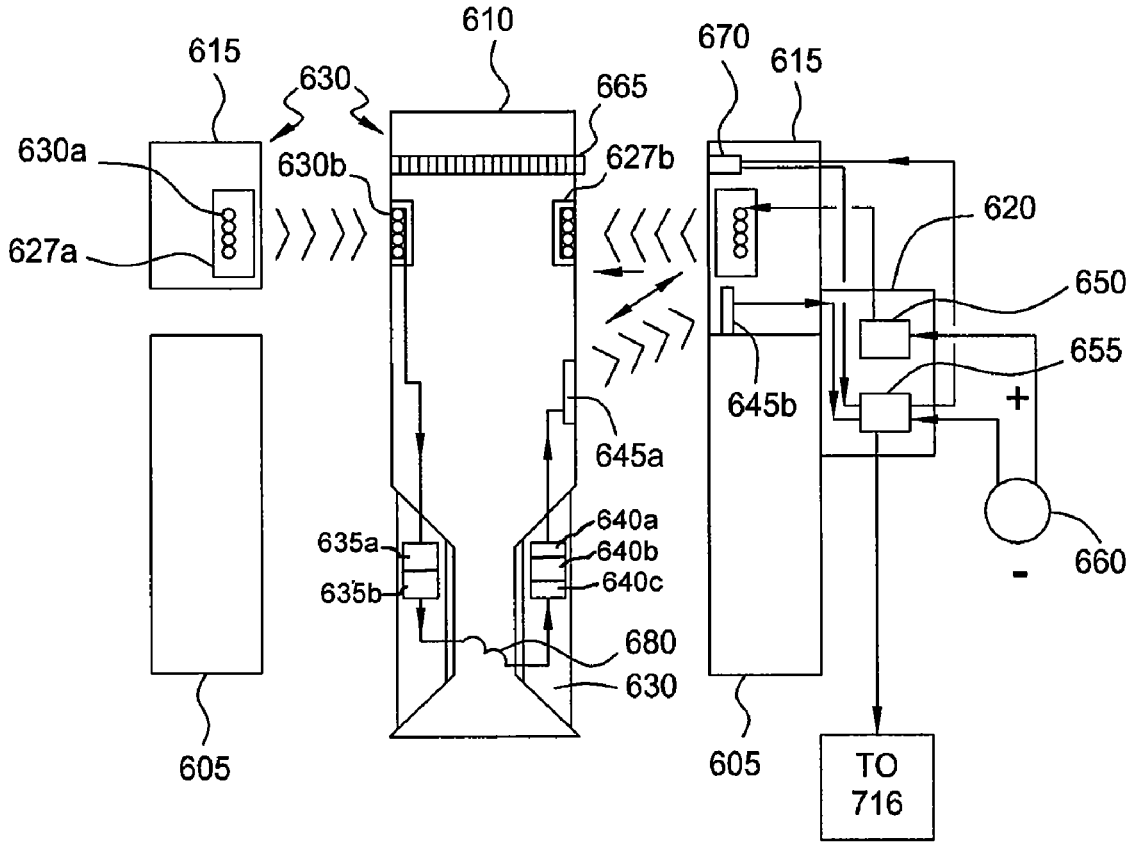
FIG. 6I is an electrical diagram showing data and electrical communication between the torque shaft and a housing of the torque sub.

FIG. 6I is an electrical diagram showing data and electrical communication between the torque shaft 610 and the housing 605 of the torque sub 600. A power source 660 is provided. The power source 660 may be a battery pack disposed in the controller 620, an-onsite generator, or utility lines. The power source 660 is electrically coupled to a sine wave generator 650. Preferably, the sine wave generator 650 will output a sine wave signal having a frequency less than nine kHz to avoid electromagnetic interference. The sine wave generator 650 is in electrical communication with a primary coil 630*a* of an electrical power coupling 630.

The electrical power coupling 630 is an inductive energy transfer device. Even though the coupling 630 transfers energy between the stationary interface 615 and the rotatable torque shaft 610, the coupling 630 is devoid of any mechanical contact between the interface 615 and the torque shaft 610. In general, the coupling 630 acts similar to a common transformer in that it employs electromagnetic induction to transfer electrical energy from one circuit, via its primary coil 630*a*, to another, via its secondary coil 630*b*, and does so without direct connection between circuits. The coupling 630 includes the secondary coil 630*b* mounted on the rotatable torque shaft 610. The primary 630*a* and secondary 630*b* coils are structurally decoupled from each other.

The primary coil 630*a* may be encased in a polymer 627*a*, such as epoxy. A coil housing 627*b* may be disposed in the groove 610*b*. The coil housing 627*b* is made from a polymer and may be assembled from two halves to facilitate insertion around the groove 610*b*. The secondary coil 630*b* may then be wrapped around the coil housing 627*b* in the groove 610*b*. Optionally, the secondary coil 630*b* is then molded in the coil housing 627*b* with a polymer. The primary 630*a* and secondary coils 630*b* are made from an electrically conductive material, such as copper, copper alloy, aluminum, or aluminum alloy. The primary 630*a* and/or secondary 630*b* coils may be jacketed with an insulating polymer. In operation, the alternating current (AC) signal generated by sine wave generator 650 is applied to the primary coil 630*a*. When the AC flows through the primary coil 630*a*, the resulting magnetic flux induces an AC signal across the secondary coil 630*b*. The induced voltage causes a current to flow to rectifier 635*a* and direct current (DC) voltage regulator (DCRR) 635*b*. A constant power is transmitted to the DCRR 635*b*, even when torque shaft 610 is rotated by the top drive 100. The primary coil 630*a* and the secondary coil 630*b* have their parameters (i.e., number of wrapped wires) selected so that an appropriate voltage may be generated by the sine wave generator 650 and applied to the primary coil 630*a* to develop an output signal across the secondary coil 630*b*. Alternatively, conventional slip rings, roll rings, or transmitters using fluid metal may be used instead of the electrical coupling 630 or a battery pack may be disposed in the torque shaft 610, thereby eliminating the need for the electrical coupling 630 or alternatives.

The rectifier 635*a* converts the induced AC signal from the secondary coil 630*b* into a suitable DC signal for use by the other electrical components of the torque shaft 610. The DCRR 635*b* outputs a first signal to the strain gages 680 and a second signal to an amplifier and microprocessor controller (AMC) 640*a*. The first signal is split into sub-signals which flow across the strain gages 680, are then amplified by the amplifier 640*b*, and are fed to the controller 640*a*. The controller 640*a* converts the analog signals from the strain gages 680 into digital signals, multiplexes them into a data stream, and outputs the data stream to a modem 640*c* (preferably a radio frequency modem). The modem 640*c* modulates the data stream for transmission from antenna 645*a*. The antenna 645*a* transmits the encoded data stream to an antenna 645*b* disposed in the interface 615. Alternatively, the analog signals from the strain gages may be multiplexed and modulated without conversion to digital format. Alternatively, conventional slip rings, an electric swivel coupling, roll rings, or transmitters using fluid metal may be used to transfer data from the torque shaft 610 to the interface 615.

Rotationally coupled to the torque shaft 610 is a turns gear 665. Disposed in the interface 615 is a proximity sensor 670. The gear/sensor 665,670 arrangement is optional. Various types of gear/sensor 665,670 arrangements are known in the art and would be suitable. The proximity sensor 665 senses movement of the gear 670. Preferably, a sensitivity of the gear/sensor 665,670 arrangement is one-tenth of a turn, more preferably one-hundredth of a turn, and most preferably one-thousandth of a turn. Alternatively a friction wheel/encoder device (see FIG. 9) or a gear and pinion arrangement may be used instead of a gear/sensor arrangement. A microprocessor controller 655 may provide power to the proximity sensor 670 and receives an analog signal indicative of movement of the gear 665 therefrom. The controller 655 may convert the analog signal from the proximity sensor 670 and convert it to a digital format.

The antenna 645*b* sends the received data stream to a modem 655. The modem 655 demodulates the data signal and outputs it to the controller 655. The controller 655 de-codes the data stream, combines the data stream with the turns data, and re-formats the data stream into a usable input (i.e., analog, field bus, or Ethernet) for a make-up computer system 706 (see FIG. 7). The controller 655 is also powered by the power source 660. The controller 655 may also process the data from strain gages 680 and proximity sensor 665 to calculate respective torque, longitudinal load, and turns values therefrom. The controller 655 may also be connected to a wide area network (WAN) (preferably, the Internet) so that office engineers/technicians may remotely communicate with the controller 655. Further, a personal digital assistant (PDA) may also be connected to the WAN so that engineers/technicians may communicate with the controller 655 from any worldwide location.

The interface controller 655 may also send data to the torque shaft controller 640 via the antennas 645*a, b*. A separate channel may be used for communication from the interface controller 655 to the torque shaft controller 640. The interface controller 655 may send commands to vary operating parameters of the torque shaft 610 and/or to calibrate the torque shaft 610 (i.e., strain gages 680*t, w*) before operation. In addition, the interface controller 655 may also control operation of the top drive 100 and/or the torque head 300 or the spear 200.

Figure 7:
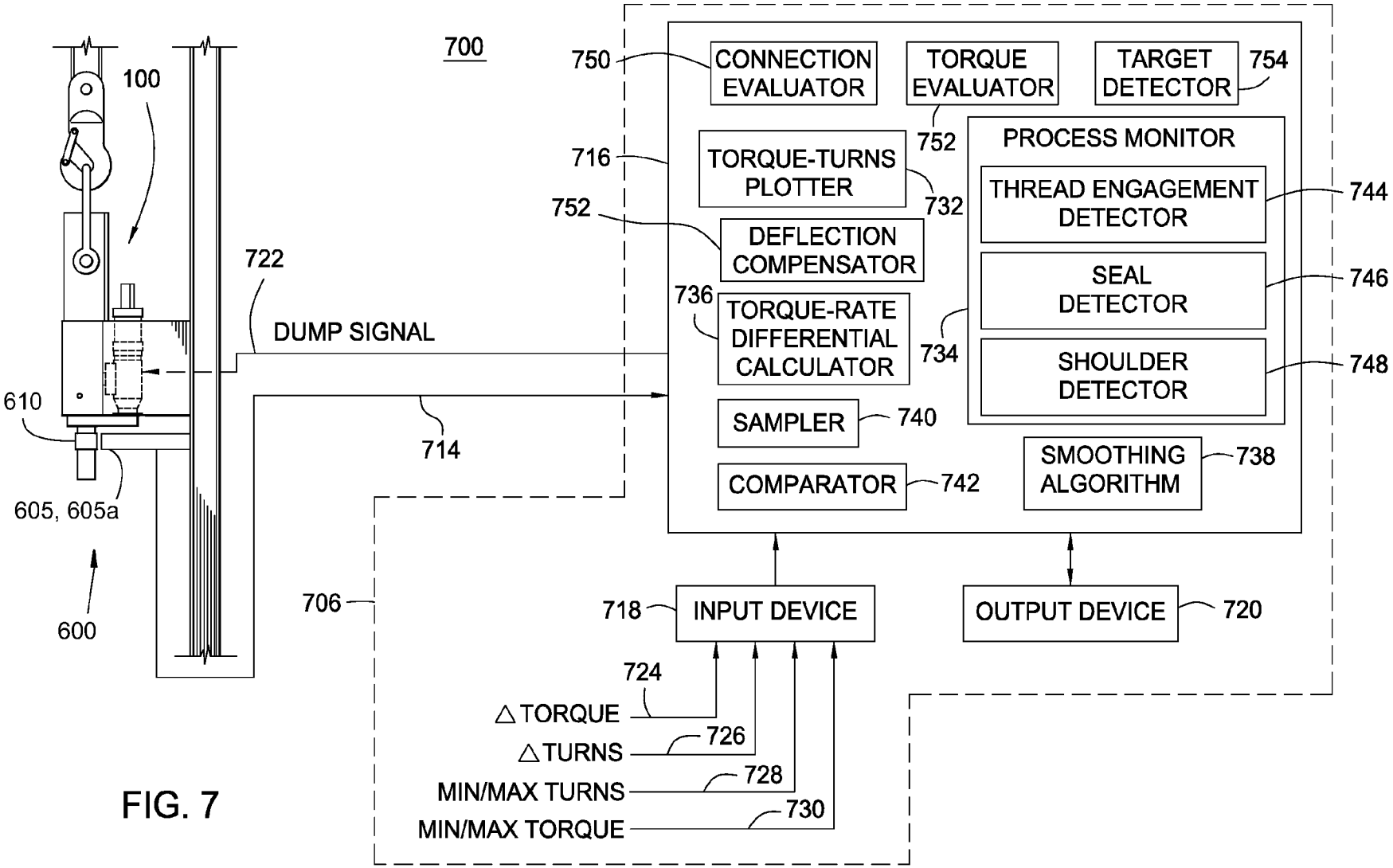
FIG. 7 is a block diagram illustrating a tubular make-up system implementing the torque sub of FIG. 6.

FIG. 7 is a block diagram illustrating a tubular make-up system implementing the torque sub of FIG. 6. Generally, the tubular make-up system 700 includes the top drive 100, torque sub 600, and the computer system 706. A computer 716 of the computer system 706 monitors the turns count signals and torque signals 714 from torque sub 600 and compares the measured values of these signals with predetermined values. In one embodiment, the predetermined values are input by an operator for a particular tubing connection. The predetermined values may be input to the computer 716 via an input device, such as a keypad, which can be included as one of a plurality of input devices 718.

Illustrative predetermined values which may be input, by an operator or otherwise, include a delta torque value 724, a delta turns value 726, minimum and maximum turns values 728 and minimum and maximum torque values 730. During makeup of a tubing assembly, various output may be observed by an operator on output device, such as a display screen, which may be one of a plurality of output devices 720. The format and content of the displayed output may vary in different embodiments. By way of example, an operator may observe the various predefined values which have been input for a particular tubing connection. Further, the operator may observe graphical information such as a representation of the torque rate curve 500 and the torque rate differential curve 500*a*. The plurality of output devices 720 may also include a printer such as a strip chart recorder or a digital printer, or a plotter, such as an x-y plotter, to provide a hard copy output. The plurality of output devices 720 may further include a horn or other audio equipment to alert the operator of significant events occurring during make-up, such as the shoulder condition, the terminal connection position and/or a bad connection.

Upon the occurrence of a predefined event(s), the computer system 706 may output a dump signal 722 to automatically shut down the top drive unit 100. For example, dump signal 722 may be issued upon detecting the terminal connection position and/or a bad connection.

The comparison of measured turn count values and torque values with respect to predetermined values is performed by one or more functional units of the computer 716. The functional units may generally be implemented as hardware, software or a combination thereof. By way of illustration of a particular embodiment, the functional units are described as software. In one embodiment, the functional units include a torque-turns plotter algorithm 732, a process monitor 734, a torque rate differential calculator 736, a smoothing algorithm 738, a sampler 740, a comparator 742, and a deflection compensator 752. The process monitor 734 includes a thread engagement detection algorithm 744, a seal detection algorithm 746 and a shoulder detection algorithm 748. It should be understood, however, that although described separately, the functions of one or more functional units may in fact be performed by a single unit, and that separate units are shown and described herein for purposes of clarity and illustration. As such, the functional units 732-742,752 may be considered logical representations, rather than well-defined and individually distinguishable components of software or hardware.

The deflection compensator 752 includes a database of predefined values or a formula derived therefrom for various torque and system deflections resulting from application of various torque on the top drive unit 100. These values (or formula) may be calculated theoretically or measured empirically. Since the top drive unit 100 is a relatively complex machine, it may be preferable to measure deflections at various torque since a theoretical calculation may require extensive computer modeling, i.e. finite element analysis. Empirical measurement may be accomplished by substituting a rigid member, i.e. a blank tubular, for the premium grade assembly 400 and causing the top drive 100 to exert a range of torques corresponding to a range that would be exerted on the tubular grade assembly to properly make-up a connection. In the case of the top drive unit 100, the blank may be only a few feet long so as not to compromise rigidity. The torque and rotation values provided by torque sub 600, respectively, would then be monitored and recorded in a database. The test may then be repeated to provide statistical samples. Statistical analysis may then be performed to exclude anomalies and/or derive a formula. The test may also be repeated for different size tubulars to account for any change in the stiffness of the top drive 100 due to adjustment of the units for different size tubulars. Alternatively, only deflections for higher values (i.e. at a range from the shoulder condition to the terminal condition) need be measured.

Deflection of tubular member 402, preferably, will also be added into the system deflection. Theoretical formulas for this deflection may readily be available. Alternatively, instead of using a blank for testing the top drive, the end of member 402 distal from the top drive may simply be locked into a spider. The top drive 100 may then be operated across the desired torque range while measuring and recording the torque and rotation values from the torque sub 600. The measured rotation value will then be the rotational deflection of both the top drive 100 and the tubular member 402. Alternatively, the deflection compensator may only include a formula or database of torques and deflections for just the tubular member 402.

In operation, two threaded members 402,404 are brought together. The box 406 is usually made-up on tubular 404 off-site before the tubulars 402,404 are transported to the rig. One of the threaded members (i.e., tubular 402) is rotated by the top drive 100 while the other tubular 404 is held by the spider 60. The applied torque and rotation are measured at regular intervals throughout a pipe connection makeup. In one embodiment, the box 406 may be secured against rotation so that the turns count signals accurately reflect the rotation of the tubular 402. Alternatively or additionally, a second turns counter may be provided to sense the rotation of the box 406. The turns count signal issued by the second turns counter may then be used to correct (for any rotation of the box 406) the turns count signals.

At each interval, the rotation value may be compensated for system deflection. The term system deflection encompasses deflection of the top drive 100 and/or the tubular 402. To compensate for system deflection, the deflection compensator 752 utilizes the measured torque value to reference the predefined values (or formula) to find/calculate the system deflection for the measured torque value. The deflection compensator 752 then subtracts the system deflection value from the measured rotation value to calculate a corrected rotation value. Alternatively, a theoretical formula for deflection of the tubular member 402 may be pre-programmed into the deflection compensator 752 for a separate calculation of deflection and then the deflection may be added to the top drive deflection to calculate the system deflection during each interval. Alternatively, the deflection compensator 752 may only compensate for the deflection of the tubular member 402.

The frequency with which torque and rotation are measured may be specified by the sampler 740. The sampler 740 may be configurable, so that an operator may input a desired sampling frequency. The measured torque and corrected rotation values may be stored as a paired set in a buffer area of computer memory. Further, the rate of change of torque with corrected rotation (i.e., a derivative) is calculated for each paired set of measurements by the torque rate differential calculator 736. At least two measurements are needed before a rate of change calculation can be made. In one embodiment, the smoothing algorithm 738 operates to smooth the derivative curve (e.g., by way of a running average). These three values (torque, corrected rotation and rate of change of torque) may then be plotted by the plotter 732 for display on the output device 720.

These three values (torque, corrected rotation and rate of change of torque) are then compared by the comparator 742, either continuously or at selected rotational positions, with predetermined values. For example, the predetermined values may be minimum and maximum torque values and minimum and maximum turn values.

Based on the comparison of measured/calculated/corrected values with predefined values, the process monitor 734 determines the occurrence of various events and whether to continue rotation or abort the makeup. In one embodiment, the thread engagement detection algorithm 744 monitors for thread engagement of the two threaded members. Upon detection of thread engagement a first marker is stored. The marker may be quantified, for example, by time, rotation, torque, a derivative of torque or time, or a combination of any such quantifications. During continued rotation, the seal detection algorithm 746 monitors for the seal condition. This may be accomplished by comparing the calculated derivative (rate of change of torque) with a predetermined threshold seal condition value. A second marker indicating the seal condition is stored when the seal condition is detected. At this point, the turns value and torque value at the seal condition may be evaluated by the connection evaluator 750.

For example, a determination may be made as to whether the corrected turns value and/or torque value are within specified limits. The specified limits may be predetermined, or based off of a value measured during makeup. If the connection evaluator 750 determines a bad connection, rotation may be terminated. Otherwise rotation continues and the shoulder detection algorithm 748 monitors for shoulder condition. This may be accomplished by comparing the calculated derivative (rate of change of torque) with a predetermined threshold shoulder condition value. When the shoulder condition is detected, a third marker indicating the shoulder condition is stored. The connection evaluator 750 may then determine whether the turns value and torque value at the shoulder condition are acceptable.

In one embodiment the connection evaluator 750 determines whether the change in torque and rotation between these second and third markers are within a predetermined acceptable range. If the values, or the change in values, are not acceptable, the connection evaluator 750 indicates a bad connection. If, however, the values/change are/is acceptable, the target calculator 752 calculates a target torque value and/or target turns value. The target value is calculated by adding a predetermined delta value (torque or turns) to a measured reference value(s). The measured reference value may be the measured torque value or turns value corresponding to the detected shoulder condition. In one embodiment, a target torque value and a target turns value are calculated based off of the measured torque value and turns value, respectively, corresponding to the detected shoulder condition.

Upon continuing rotation, the target detector 754 monitors for the calculated target value(s). Once the target value is reached, rotation is terminated. In the event both a target torque value and a target turns value are used for a given makeup, rotation may continue upon reaching the first target or until reaching the second target, so long as both values (torque and turns) stay within an acceptable range. Alternatively, the deflection compensator 752 may not be activated until after the shoulder condition has been detected.

In one embodiment, system inertia is taken into account and compensated for to prevent overshooting the target value. System inertia includes mechanical and/or electrical inertia and refers to the system's lag in coming to a complete stop after the dump signal is issued. As a result of such lag, the top drive unit 100 continues rotating the tubing member even after the dump signal is issued. As such, if the dump signal is issued contemporaneously with the detection of the target value, the tubing may be rotated beyond the target value, resulting in an unacceptable connection. To ensure that rotation is terminated at the target value (after dissipation of any inherent system lag) a preemptive or predicative dump approach is employed. That is, the dump signal is issued prior to reaching the target value. The dump signal may be issued by calculating a lag contribution to rotation which occurs after the dump signal is issued. In one embodiment, the lag contribution may be calculated based on time, rotation, a combination of time and rotation, or other values. The lag contribution may be calculated dynamically based on current operating conditions such as RPMs, torque, coefficient of thread lubricant, etc. In addition, historical information may be taken into account. That is, the performance of a previous makeup(s) for a similar connection may be relied on to determine how the system will behave after issuing the dump signal. Persons skilled in the art will recognize other methods and techniques for predicting when the dump signal should be issued.

In one embodiment, the sampler 740 continues to sample at least rotation to measure counter rotation which may occur as a connection relaxes. When the connection is fully relaxed, the connection evaluator 750 determines whether the relaxation rotation is within acceptable predetermined limits. If so, makeup is terminated. Otherwise, a bad connection is indicated.

In the previous embodiments turns and torque are monitored during makeup. However, it is contemplated that a connection during makeup may be characterized by either or both of theses values. In particular, one embodiment provides for detecting a shoulder condition, noting a measured turns value associated with the shoulder condition, and then adding a predefined turns value to the measured turns value to arrive at a target turns value. Alternatively or additionally, a measured torque value may be noted upon detecting a shoulder condition and then added to a predefined torque value to arrive at a target torque value. Accordingly, it should be emphasized that either or both a target torque value and target turns value may be calculated and used as the termination value at which makeup is terminated. Preferably, the target value is based on a delta turns value. A delta turns value can be used to calculate a target turns value without regard for a maximum torque value. Such an approach is made possible by the greater degree of confidence achieved by relying on rotation rather than torque.

Whether a target value is based on torque, turns or a combination, the target values are not predefined, i.e., known in advance of determining that the shoulder condition has been reached. In contrast, the delta torque and delta turns values, which are added to the corresponding torque/turn value as measured when the shoulder condition is reached, are predetermined. In one embodiment, these predetermined values are empirically derived based on the geometry and characteristics of material (e.g., strength) of two threaded members being threaded together.

In addition to geometry of the threaded members, various other variables and factors may be considered in deriving the predetermined values of torque and/or turns. For example, the lubricant and environmental conditions may influence the predetermined values. In one aspect, the present invention compensates for variables influenced by the manufacturing process of tubing and lubricant. Oilfield tubes are made in batches, heat treated to obtain the desired strength properties and then threaded. While any particular batch will have very similar properties, there is significant variation from batch to batch made to the same specification. The properties of thread lubricant similarly vary between batches. In one embodiment, this variation is compensated for by starting the makeup of a string using a starter set of determined parameters (either theoretical or derived from statistical analysis of previous batches) that is dynamically adapted using the information derived from each previous makeup in the string. Such an approach also fits well with the use of oilfield tubulars where the first connections made in a string usually have a less demanding environment than those made up at the end of the string, after the parameters have been 'tuned'.

Figure 5A:
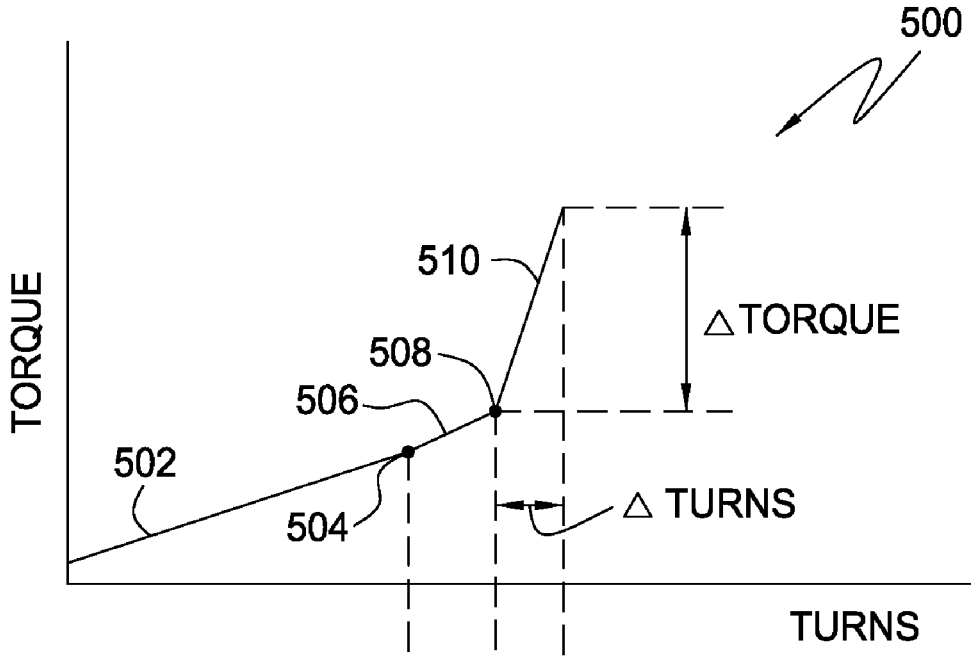
FIG. 5A (PRIOR ART)
FIG. 5A is a plot of torque with respect to turns for a premium tubular connection.
Figure 5B:
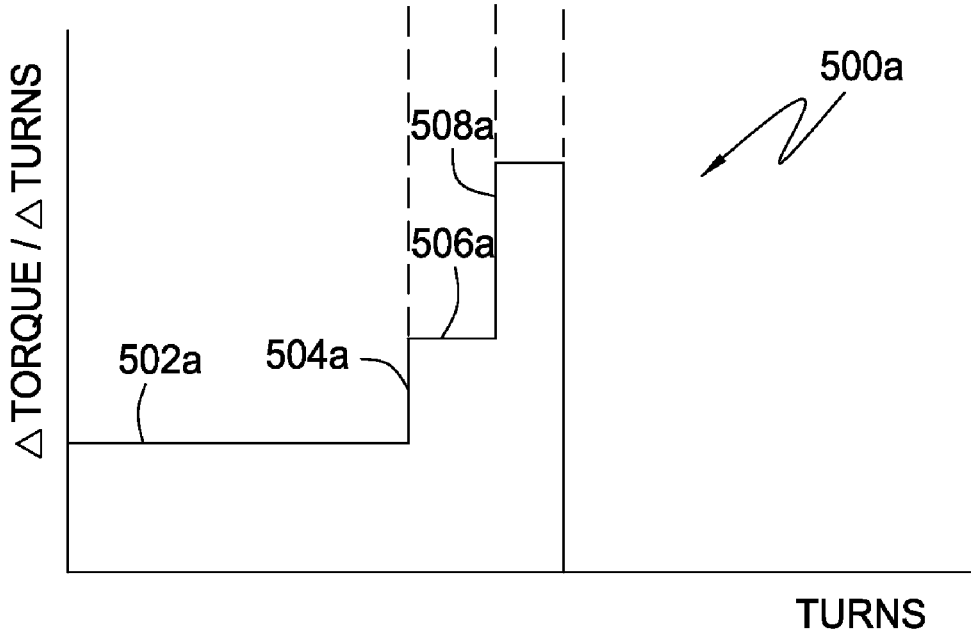
FIG. 5B (PRIOR ART)
FIG. 5B is a plot of the rate of change in torque with respect to turns for a premium tubular connection.

According to embodiments of the present invention, there is provided a method and apparatus of characterizing a connection. Such characterization occurs at various stages during makeup to determine whether makeup should continue or be aborted. In one aspect, an advantage is achieved by utilizing the predefined delta values, which allow a consistent tightness to be achieved with confidence. This is so because, while the behavior of the torque-turns curve 500 (FIG. 5) prior to reaching the shoulder condition varies greatly between makeups, the behavior after reaching the shoulder condition exhibits little variation. As such, the shoulder condition provides a good reference point on which each torque-turns curve may be normalized. In particular, a slope of a reference curve portion may be derived and assigned a degree of tolerance/variance. During makeup of a particular connection, the behavior of the torque-turns curve for the particular connection may be evaluated with respect to the reference curve. Specifically, the behavior of that portion of the curve following detection of the shoulder condition can be evaluated to determine whether the slope of the curve portion is within the allowed tolerance/variance. If not, the connection is rejected and makeup is terminated.

In addition, connection characterizations can be made following makeup. For example, in one embodiment the rotation differential between the second and third markers (seal condition and shoulder condition) is used to determine the bearing pressure on the connection seal, and therefore its leak resistance. Such determinations are facilitated by having measured or calculated variables following a connection makeup. Specifically, following a connection makeup actual torque and turns data is available. In addition, the actual geometry of the tubing and coefficient of friction of the lubricant are substantially known. As such, leak resistance, for example, can be readily determined according to methods known to those skilled in the art.

Figure 8:
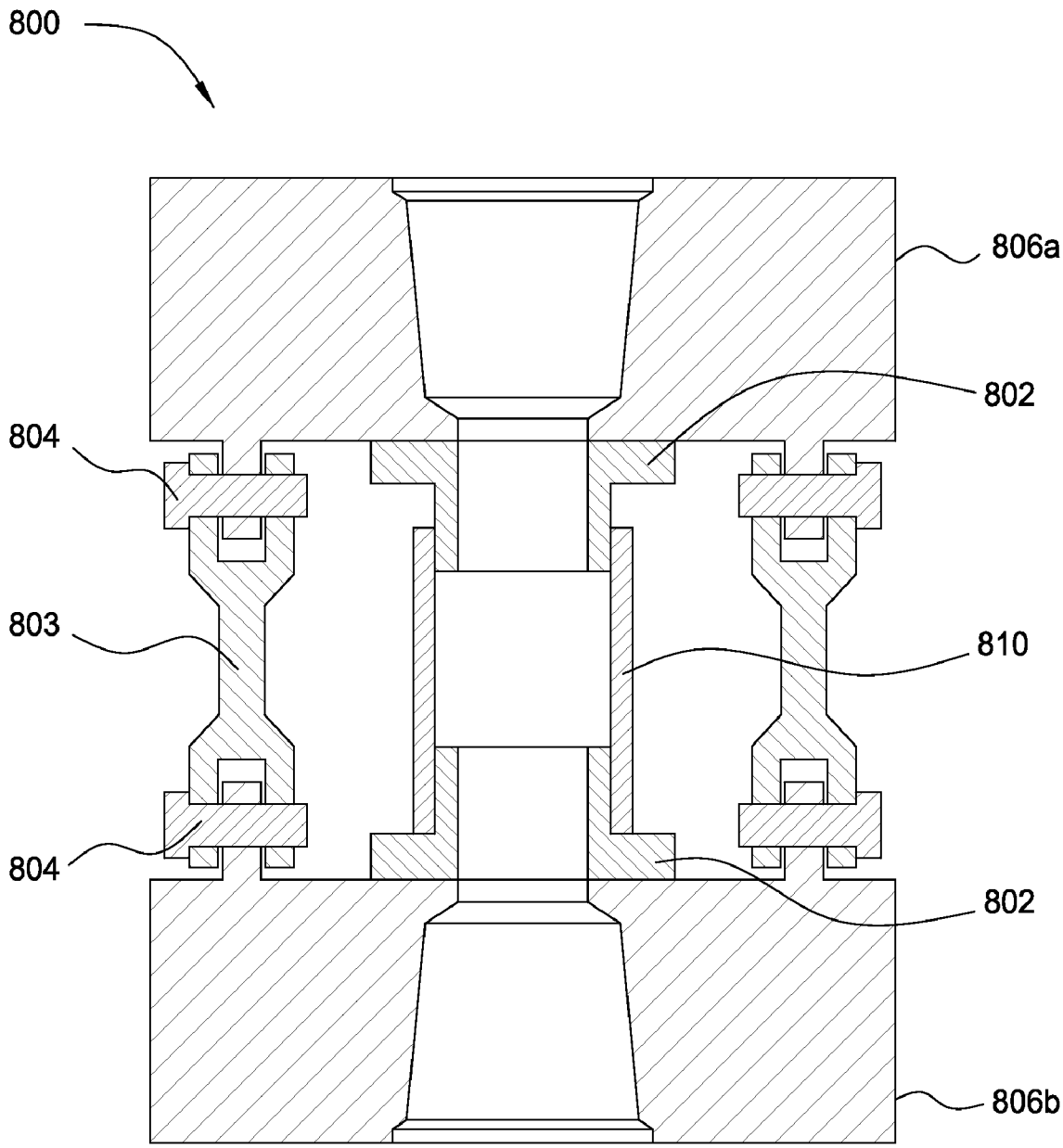
FIG. 8 is a sectional view of a torque sub, according to an alternative embodiment of the present invention.

FIG. 8 is a sectional view of a torque sub 800, according to an alternative embodiment of the present invention. The torque sub 800 includes two boxes 806*a,b*; links 803 (preferably four); splined adapters 802; and a torque shaft 810. Box 806*a* and/or box 806*b* may be replaced by a pin as necessary to connect the torque shaft 810 to the top drive 100 and the spear 200 or the torque head 300. At least one torsional strain gage 680*t* (preferably two Wheatstone bridges) is disposed on the torque shaft 810. One or more longitudinal strain gages 680*w* may also be disposed on one or more of the links 803. The torque shaft 810 has two straight-splined ends. Each splined end mates with one of the splined adapters 802, thereby only torque is transmitted through torque shaft 810. The links 803 are coupled to the boxes with pins 804 and lugs, thereby transmitting only longitudinal loads through the links 803. The turns may be measured with a lower turns counter 905*b* (see FIG. 9), thereby eliminating the need for the deflection compensator 752. Power and data communication may be provided similarly as for torque sub 600. The interface 615 may instead be located in a housing of the top drive.

Figure 9:
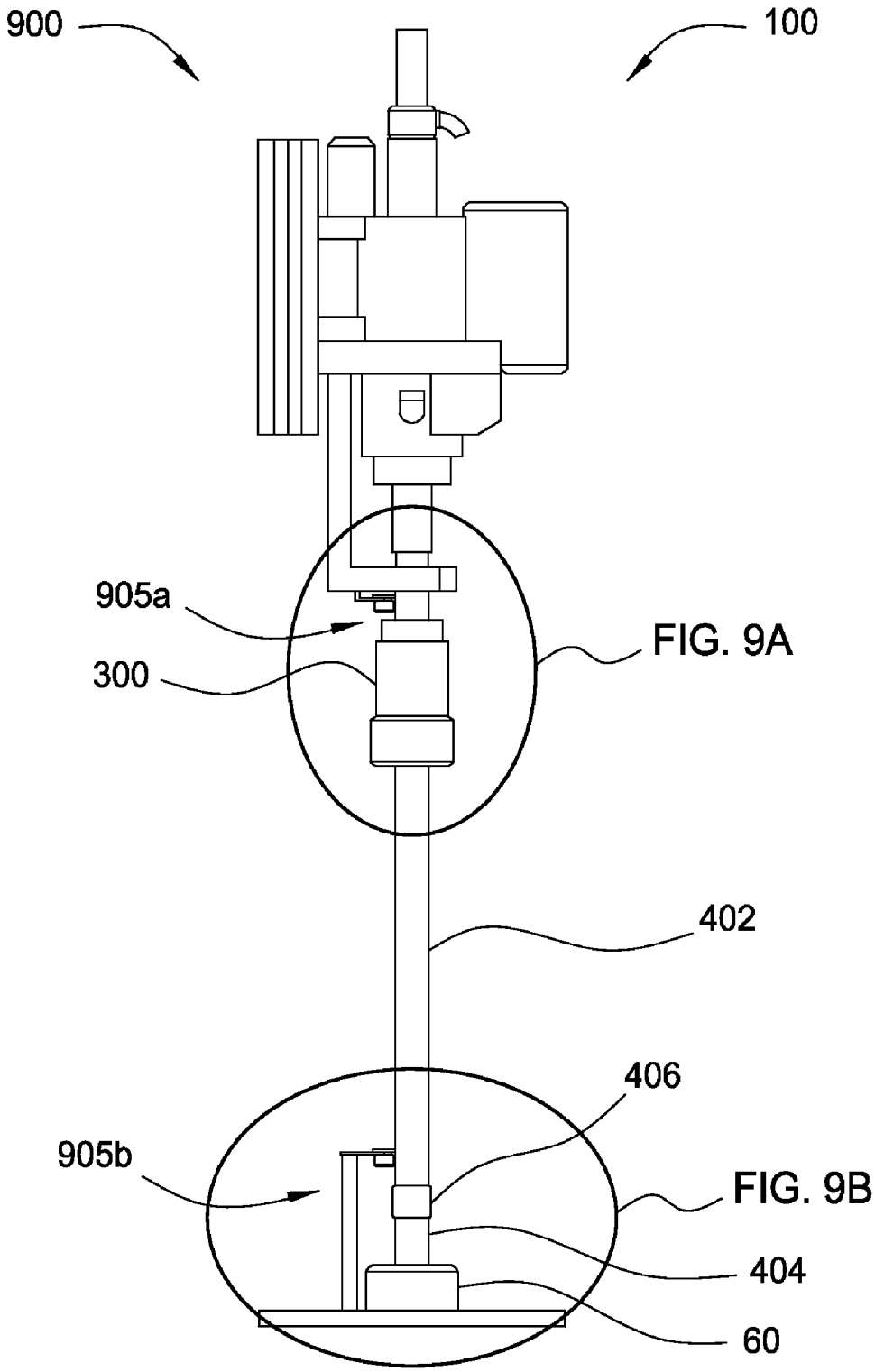
FIG. 9 is a side view of a top drive system employing a torque meter, according to another alternative embodiment of the present invention.
Figure 9A:
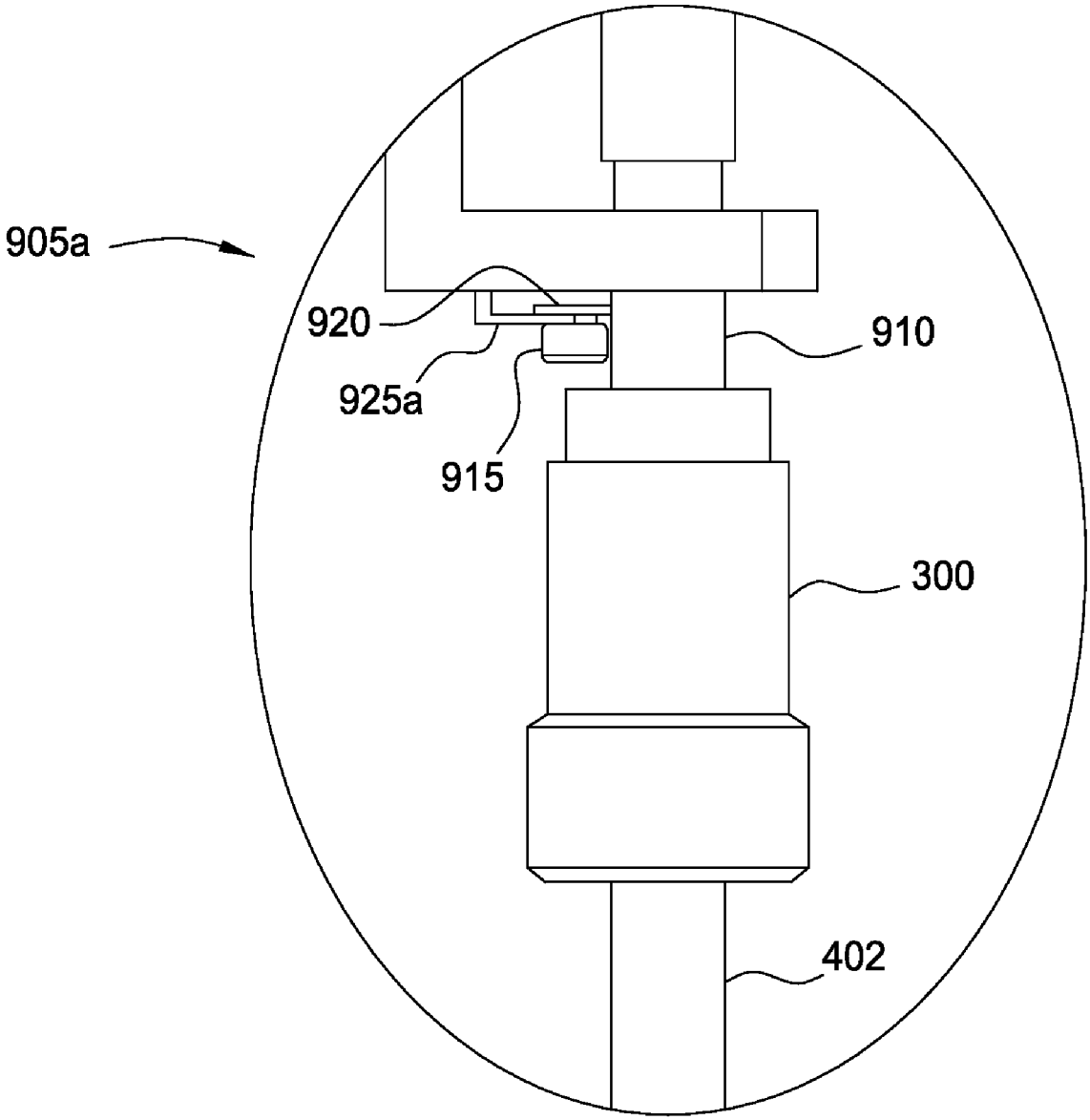
FIG. 9A is an enlargement of a portion of FIG. 9.
Figure 9B:
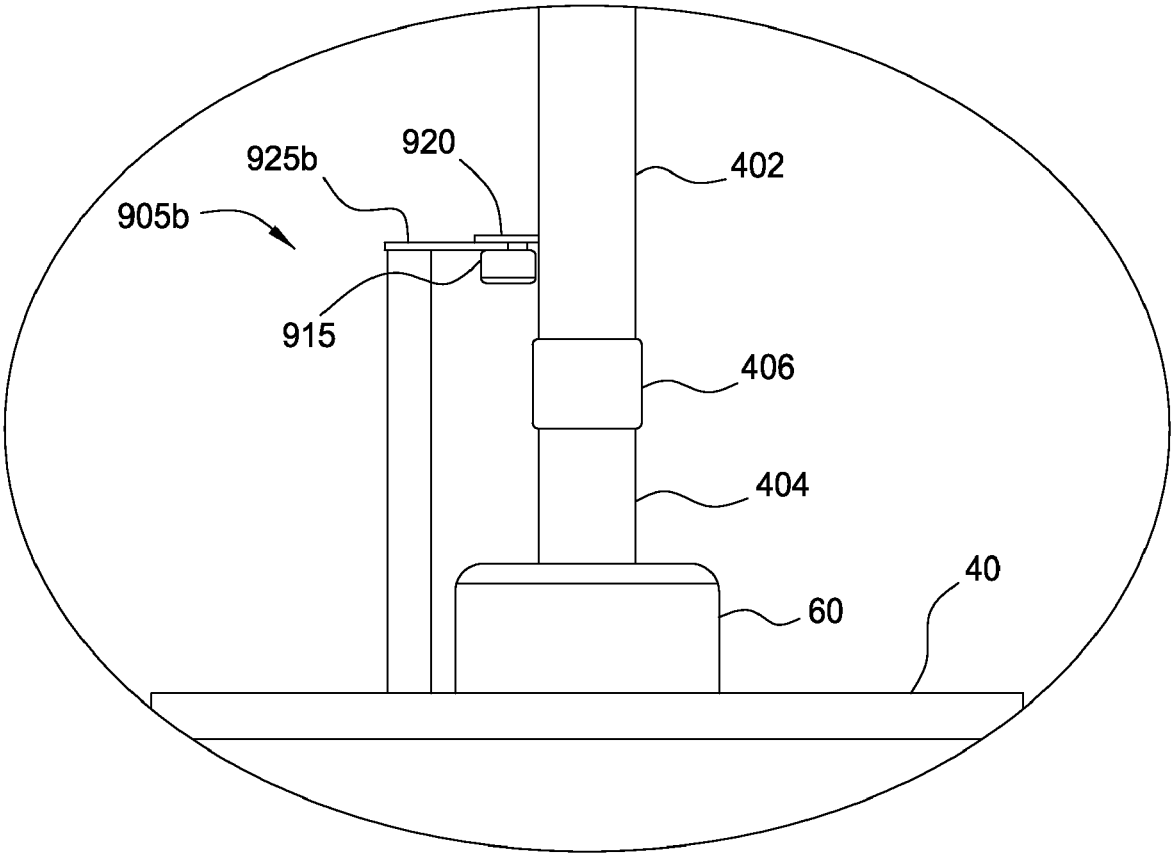
FIG. 9B is an enlargement of another portion of FIG. 9.

FIG. 9 is a side view of a top drive system employing a torque meter 900, according to another alternative embodiment of the present invention. FIG. 9A is an enlargement of a portion of FIG. 9. FIG. 9B is an enlargement of another portion of FIG. 9. The torque meter 900 includes upper 905*a* and lower 905*b* turns counters. The upper turns counter 905*a* is located between the top drive 100 and the torque head 300. The lower turns counter is located along the first tubular 402 proximate to the box 406. Each turns counter includes a friction wheel 920, an encoder 915, and a bracket 925*a,b*. The friction wheel 920 of the upper turns counter 905*a* is held into contact with a drive shaft 910 of the top drive 100. The friction wheel 920 of the lower turns counter 905*b* is held into contact with the first tubular 402. Each friction wheel is coated with a material, such as a polymer, exhibiting a high coefficient of friction with metal. The frictional contact couples each friction wheel with the rotational movement of outer surfaces of the drive shaft 910 and first tubular 402, respectively. Each encoder 915 measures the rotation of the respective friction wheel 920 and translates the rotation to an analog signal indicative thereof. Alternatively, a gear and proximity sensor arrangement or a gear and pinion arrangement may be used instead of a friction wheel for the upper 905*a* and/or lower 905*b* turns counters. In this alternate, for the lower turns counter 905*b*, the gear would be split to facilitate mounting on the first tubular 402.

Due to the arrangement of the upper 905*a* and lower 905*b* turns counters, a torsional deflection of the first tubular 402 may be measured. This is found by subtracting the turns measured by the lower turns counter 905*b* from the turns measured by the upper turns counter 905*a*. By turns measurement, it is meant that the rotational value from each turns counter 905*a,b* has been converted to a rotational value of the first tubular 402. Once the torsional deflection is known a controller or computer 706 may calculate the torque exerted on the first tubular by the top drive 100 from geometry and material properties of the first tubular. If a length of the tubular 402 varies, the length may be measured and input manually (i.e. using a rope scale) or electronically using a position signal from the draw works 105. The turns signal used for monitoring the make-up process would be that from the lower turns counter 905*b*, since the measurement would not be skewed by torsional deflection of the first tubular 402.

If an outside diameter of the first tubular 402 is not known, the tubular 402 may be rotated by a full turn without torque (not engaged with the box 406). The rotational measurement from the encoder of the lower turns counter 905*b* may be multiplied by a diameter of the drive shaft 910 and divided by an rotational measurement from the encoder of the upper turns counter 905*a*. This calculation assumes that diameters of the friction wheels are equal. Alternatively, the operation may be performed using a defined time instead of a full turn.

The torque meter 900 may be calibrated by inserting a torque sub, i.e. torque sub 600 or a conventional torque sub, between the first tubular 402 and the box 406 and exerting a range of torques on the first tubular 402. The lower turns counter 905*b* would be adjusted so that it contacted the first tubular in the same position as without the torque sub.

The lower turns counter 905*b* may also be used to control the rotational speed of the top drive 100. Once a seal or shoulder condition is reached, the rotational velocity of the first tubular 402 will noticeably decrease. This rotational velocity signal could be input to the top drive controller or the computer 716 to reduce the speed of the drive shaft 910.

In addition, the torque meter 900 may be used with buttress casing connections. The make-up length of the thread may be measured by a longitudinal measuring attachment disposed located at the top drive 100 or at the casing, i.e. in combination with the encoder 915 of the lower turns counter 905*b*.

Figure 1A:
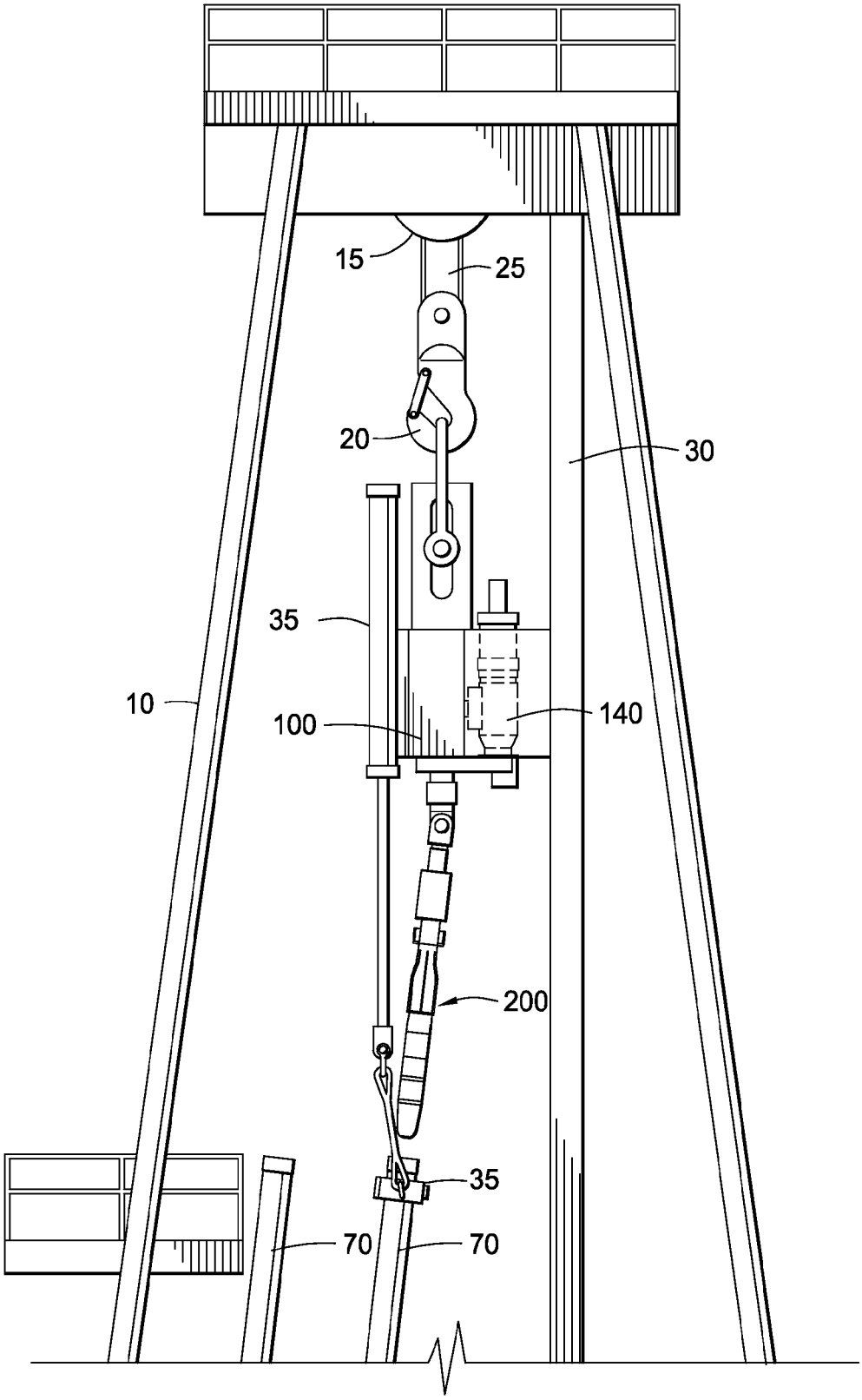
FIG. 1A (PRIOR ART)
FIG. 1A is a side view of a prior art drilling rig having a top drive and an elevator.
Figure 1B:
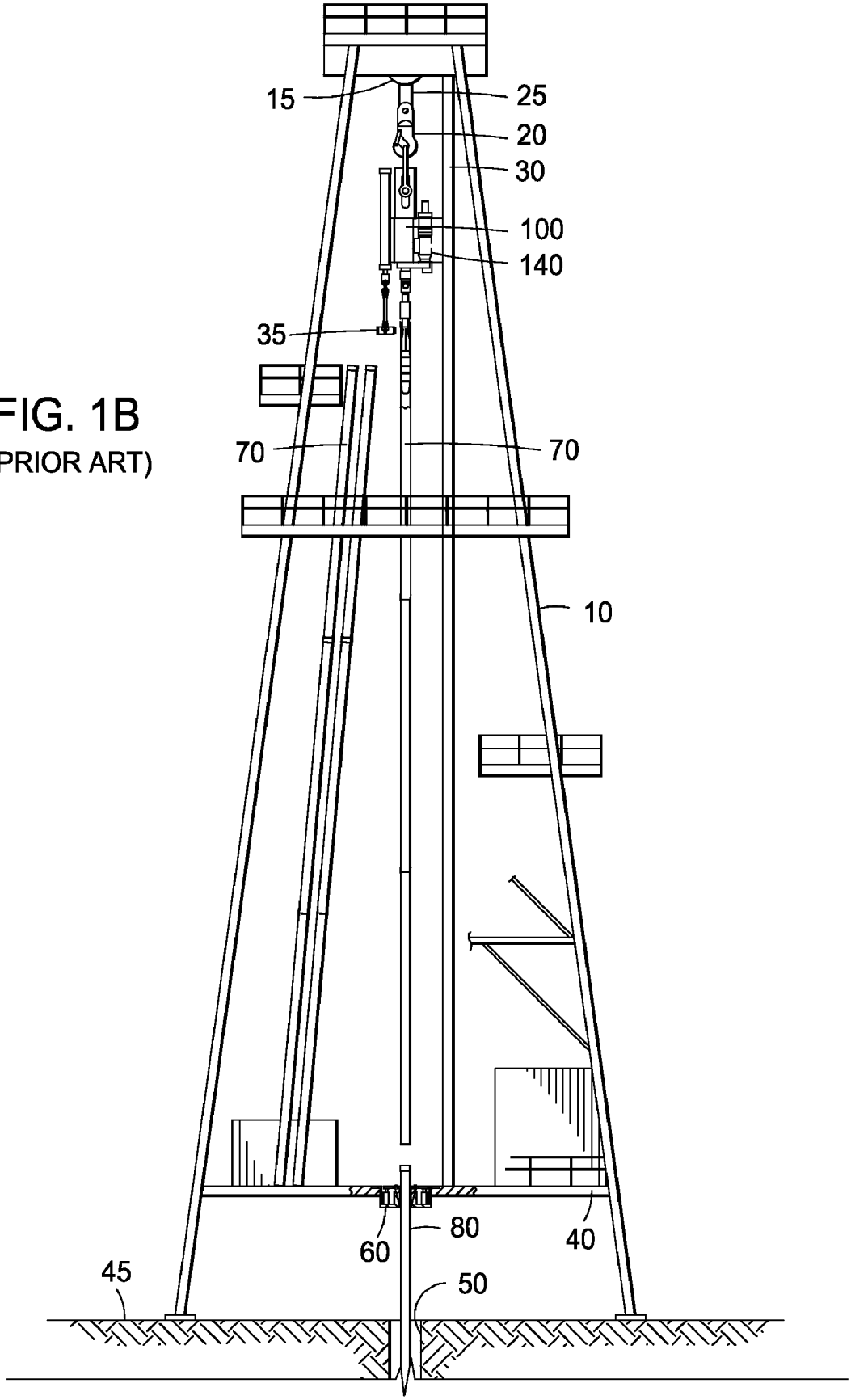
FIG. 1B (PRIOR ART)
FIG. 1B is a side view of a prior art drilling rig having a top drive, an elevator, and a spider.
Figure 1C:
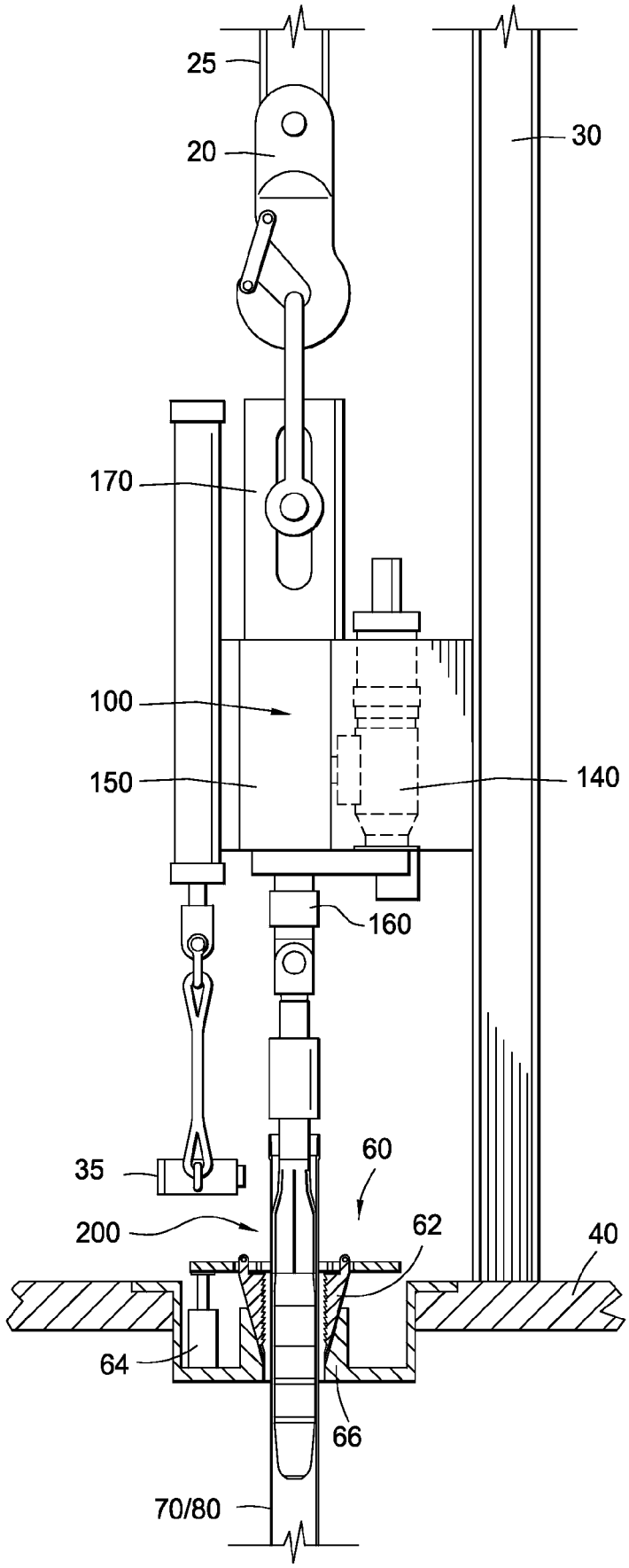
FIG. 1C (PRIOR ART)
FIG. 1C illustrates a side view of a top drive engaged to a tubular, which has been lowered through a spider.
Figure 2A:
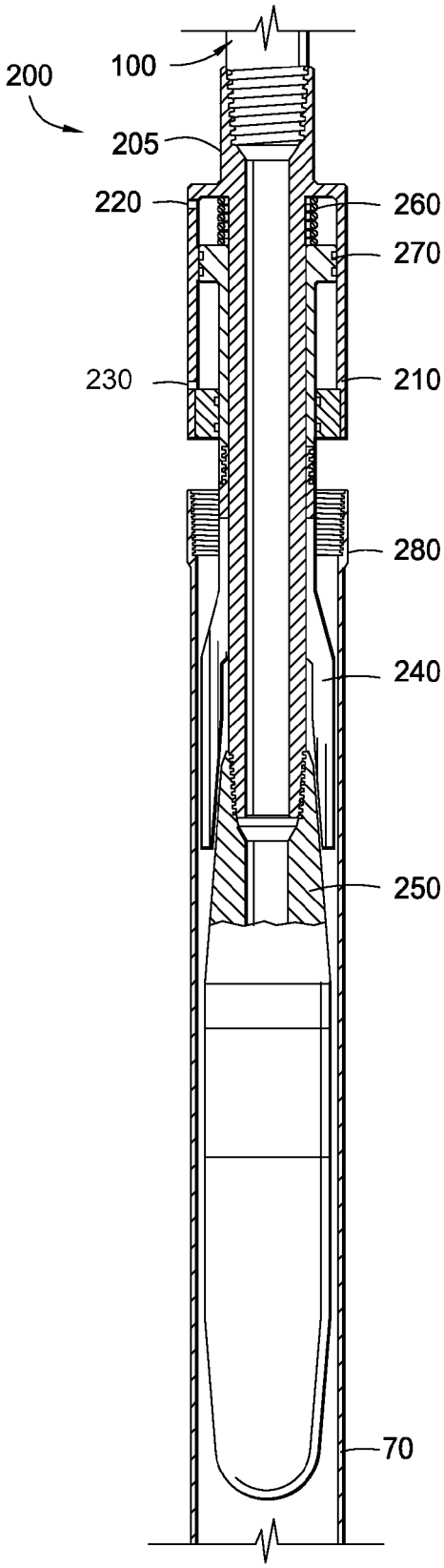
FIG. 2A (PRIOR ART)
FIG. 2A is a cross-sectional view of a spear, for coupling a top drive and a tubular, in a disengaged position.
Figure 2B:
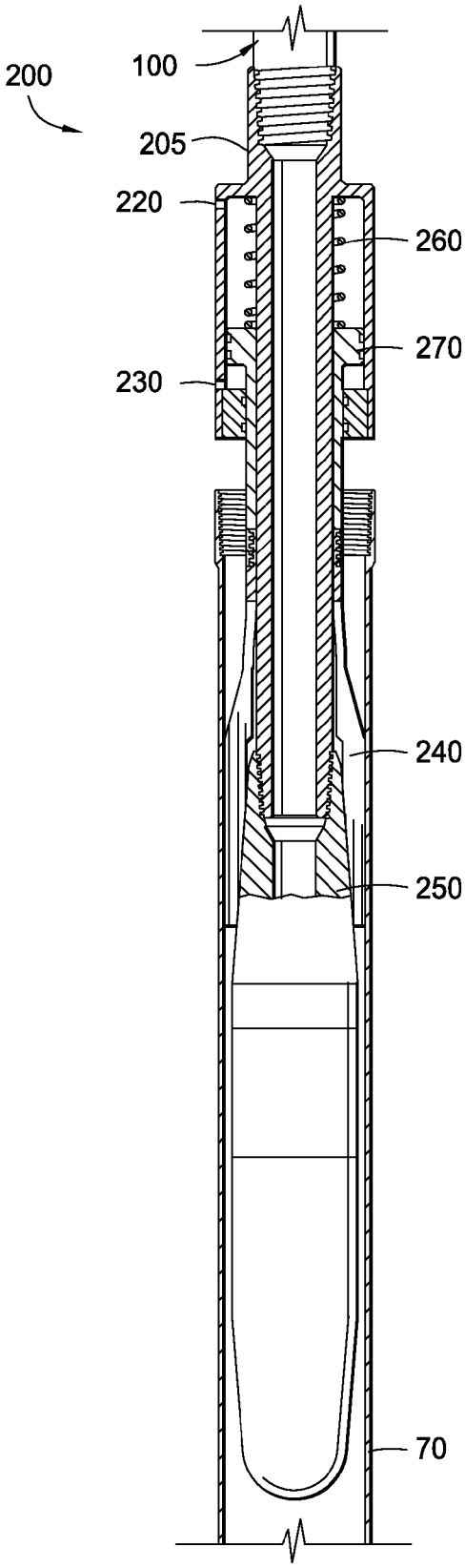
FIG. 2B (PRIOR ART)
FIG. 2B is a cross-sectional view of a spear, for coupling a top drive and a tubular, in an engaged position.
Figure 3:
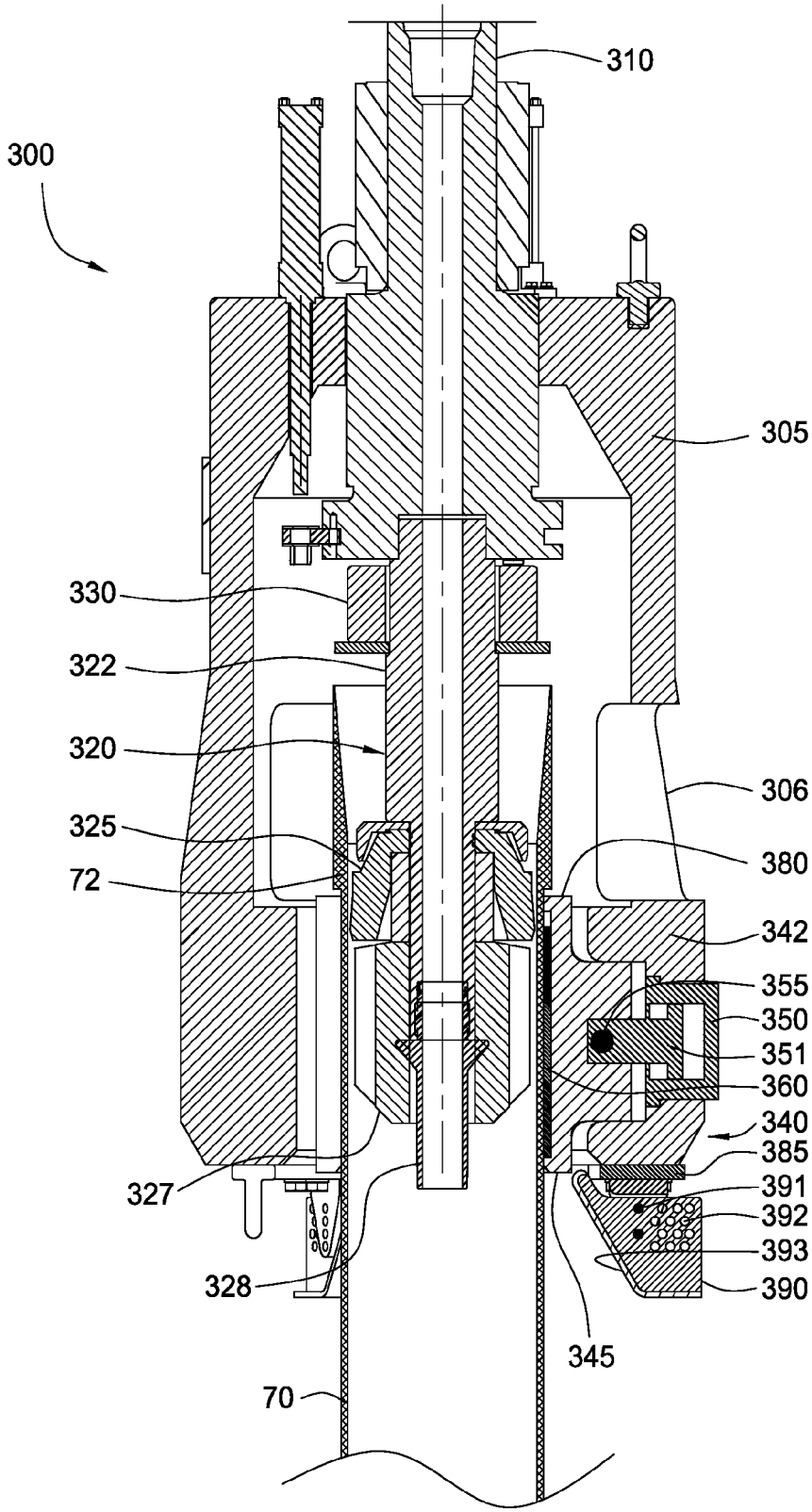
FIG. 3 (PRIOR ART)
FIG. 3 is a cross-sectional view of a prior art torque head.
Figure 3A:
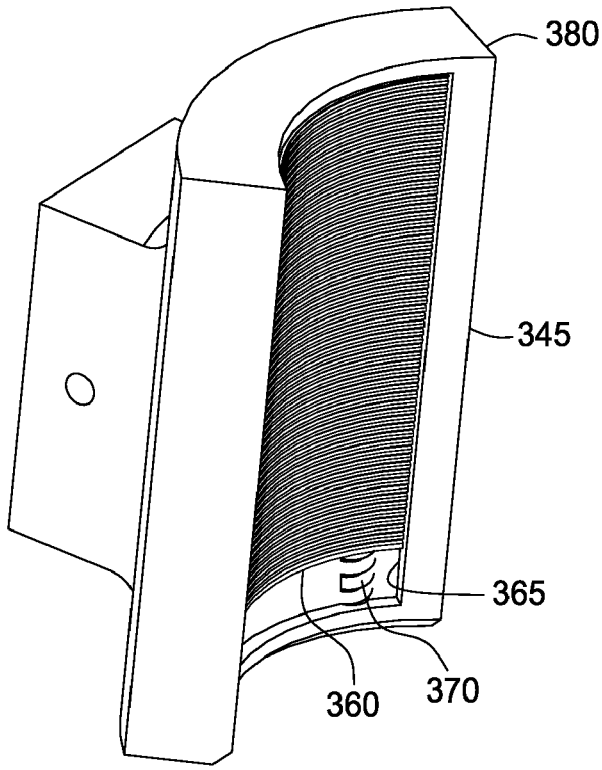
FIG. 3A (PRIOR ART)
FIGS. 3A-B are isometric views of a prior art jaw for the torque head of FIG. 3.
Figure 3B:
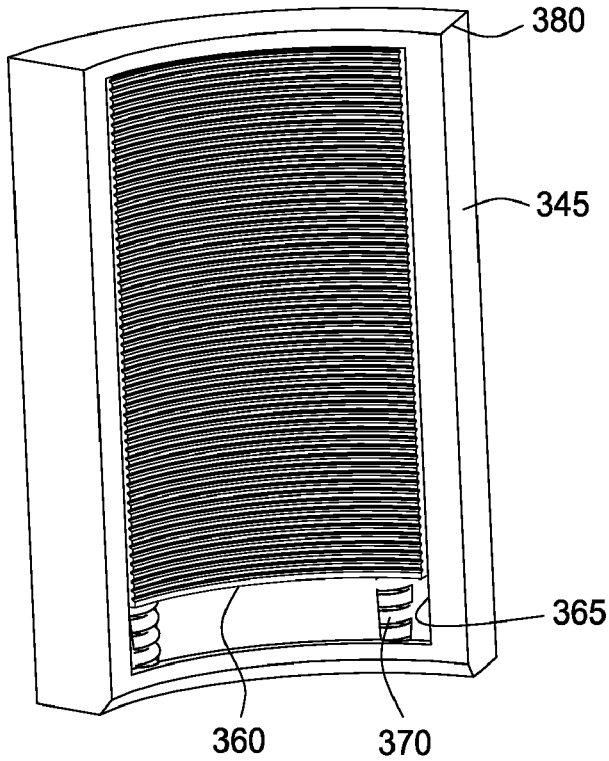
FIG. 3B (PRIOR ART)
Figure 4A:
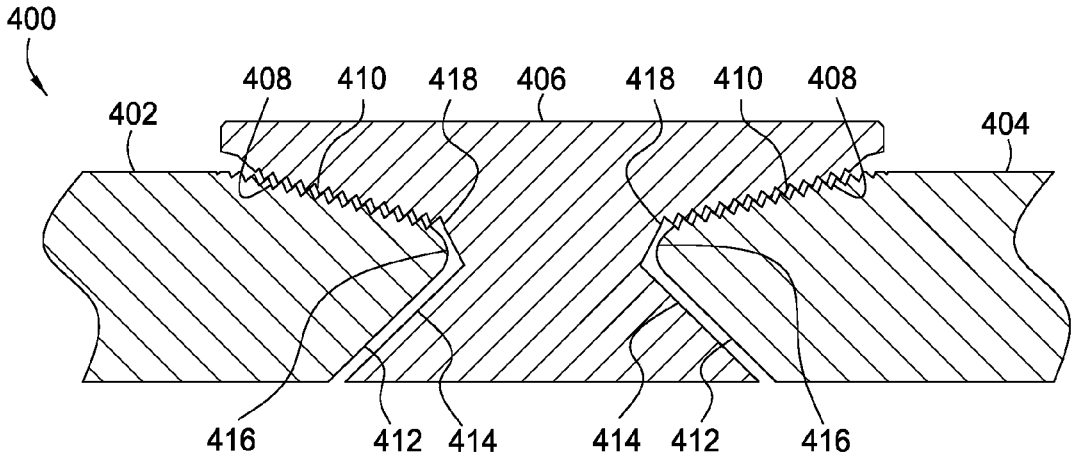
FIG. 4A (PRIOR ART)
FIG. 4A is a partial cross section view of a connection between threaded premium grade members.
Figure 4B:
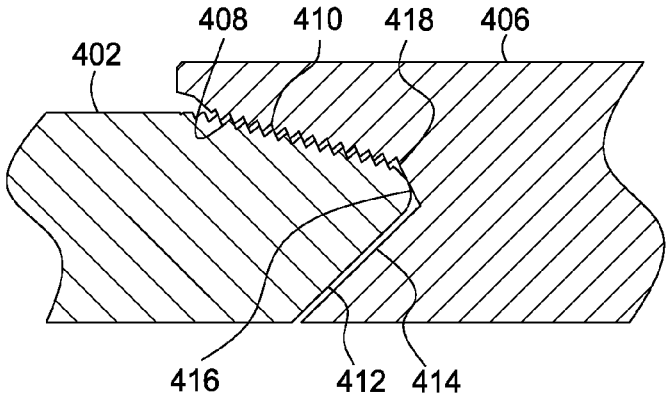
FIG. 4B (PRIOR ART)
FIG. 4B is a partial cross section view of a connection between threaded premium grade members in which a seal condition is formed by engagement between sealing surfaces.
Figure 4C:
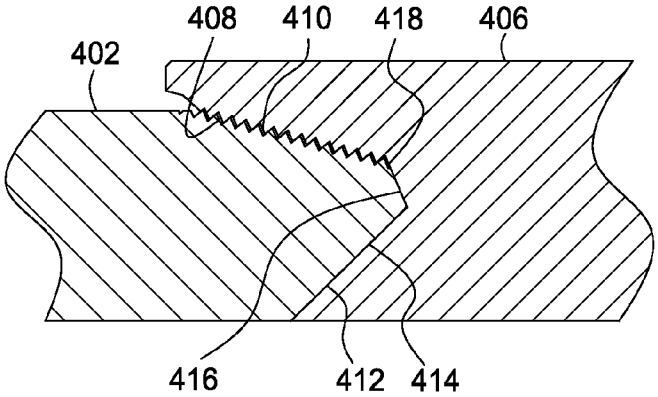
FIG. 4C (PRIOR ART)
FIG. 4C is a partial cross section view of a connection between threaded premium grade members in which a shoulder condition is formed by engagement between shoulder surfaces.

It will be appreciated that although use of the torque sub 600, the torque sub 800, and the torque meter 900 have been described with respect to a tapered premium grade connection, the embodiments are not so limited. Accordingly, the torque sub 600, the torque sub 800, and the torque meter 900 may be used for making-up parallel premium grade connections. Further, some connections do not utilize a box or coupling (such as box 406). Rather, two tubing lengths (one having external threads at one end, and the other having cooperating internals threads) are threadedly engaged directly with one another. The torque sub 600, the torque sub 800, and the torque meter 900 are equally applicable to such connections. In general, any pipe forming a metal-to-metal seal which can be detected during make up can be utilized. Further, use of the term "shoulder" or "shoulder condition" is not limited to a well-defined shoulder as illustrated in FIG. 4. It may include a connection having a plurality of metal-to-metal contact surfaces which cooperate together to serve as a "shoulder." It may also include a connection in which an insert is placed between two non-shouldered threaded ends to reinforce the connection, such as may be done in drilling with casing. In this regard, torque sub 600, the torque sub 800, and the torque meter 900 have application to any variety of tubulars characterized by function including: drill pipe, tubing/casing, risers, and tension members. The connections used on each of these tubulars must be made up to a minimum preload on a torque shoulder if they are to function within their design parameters and, as such, may be used to advantage with the present invention. The torque sub 600, the torque sub 800, and the torque meter 900 may also be used in the make-up of any oil country tubular good.

While the foregoing is directed to embodiments of the present invention, other and further embodiments of the invention may be devised without departing from the basic scope thereof, and the scope thereof is determined by the claims that follow.

The invention claimed is:

1. A system for connecting threaded tubulars for use in a wellbore, comprising:

a top drive operable to rotate a first threaded tubular relative to a second threaded tubular;

an upper turns counter for measuring rotation of an upper longitudinal end of the first tubular;

a lower turns counter for directly measuring rotation of a lower longitudinal end of the first tubular;

a torque shaft rotationally coupled to the top drive and the first tubular; and a strain gage disposed on the torque shaft for measuring a torque exerted on the torque shaft by the top drive.

2. The system of claim 1, further comprising a first antenna disposed on the torque shaft and in communication with the strain gage.

3. The system of claim 2, further comprising:

a housing having a bracket for coupling to a rail of a drilling rig; and an interface mounted on the housing and containing a second antenna for receiving a torque measurement from the first antenna.

4. The system of claim 3, further comprising an elevator operable to engage the first tubular.

5. The system of claim 3, further comprising an electrical coupling that transfers energy between:

a primary coil disposed in the interface; and a secondary coil wrapped around the torque shaft, wherein a current is generated in the secondary coil when a current is passed through the primary coil.

6. The system of claim 5, further comprising:

a rectifier disposed on the torque shaft and in electrical communication with the secondary coil; and a voltage regulator in communication with the strain gage.

7. The system of claim 3, further comprising:

a computer in communication with the interface and the turns counters and configured to perform an operation, the operation comprising:

monitoring torque and rotation measurements during rotation of the first tubular relative to the second tubular; and stopping rotation of the first tubular when a threaded connection between the first and second tubulars is complete.

8. The system of claim 7, wherein:

the operation further comprises detecting a shoulder condition during rotation of the first tubular; and the threaded connection is complete when reaching a predefined rotation value from the shoulder condition.

9. The system of claim 8, wherein detecting the shoulder condition comprises calculating and monitoring a rate of change of torque with respect to rotation.

10. The system of claim 1, further comprising a second strain gage disposed on the torque shaft for measuring a longitudinal load exerted on the torque shaft.

11. The system of claim 1, wherein the upper turns counter and the lower turns counter are used to measure rotation of the upper longitudinal end of the first tubular and lower longitudinal end of the first tubular simultaneously.

12. The system of claim 1, wherein the upper turns counter and the lower turns counter are used to determine a torsional deflection of the first tubular.

13. A method of connecting tubulars for use in a wellbore, comprising:

engaging a thread of a first tubular with a thread of a second tubular using a top drive connected to a torque shaft;

rotating the first tubular relative to the second tubular using the top drive connected to the torque shaft, thereby making up a threaded connection;

measuring a torque exerted on the first tubular by the top drive using the torque shaft;

wirelessly transmitting the measured torque from the torque shaft to a stationary housing;

directly measuring rotation of a lower longitudinal end of a first tubular using a turns counter; and stopping rotation of the first tubular when the threaded connection is complete.

14. The method of claim 13, further comprising transferring electrical energy from an interface to the torque shaft.

15. The method of claim 13, further comprising:

detecting a shoulder condition during rotation of the first tubular; and determining the threaded connection is complete when reaching a predefined rotation value from the shoulder condition.

16. The method of claim 15, wherein detecting the shoulder condition comprises calculating and monitoring a rate of change of the torque with respect to the rotation.

17. The method of claim 16, further comprising determining acceptability of the threaded connection using the rate of change of torque with respect to rotation after detecting the shoulder condition.

18. The method of claim 13, further comprising engaging the first tubular using an elevator mounted to the housing.

19. The method of claim 13, wherein the housing has a bracket coupling the housing to a rail of a drilling rig.

20. The method of claim 13, including measuring rotation of an upper longitudinal end of the first tubular using an upper turns counter.

21. The method of claim 20, wherein measuring rotation of the upper longitudinal end of the first tubular using the upper turns counter and measuring rotation of the lower longitudinal end of the first tubular using the turns counter occurs simultaneously.

22. The method of claim 20, including determining a torsional deflection of the first tubular using measurements from the upper turns counter and the turns counter.

* * * * *